US009534192B2

(12) United States Patent
Menge et al.

(10) Patent No.: US 9,534,192 B2
(45) Date of Patent: Jan. 3, 2017

(54) PHTHALOCYANINE-CONTAINING GRANULES TO DECREASE PHTHALOCYANINE DEPOSITION ON TEXTILES

(71) Applicant: BASF SE, Ludwigshafen (DE)

(72) Inventors: Ullrich Menge, Grenzach-Wyhlen (DE); Gunther Schlingloff, Muhlhausen (DE); Frank Bachmann, Freiberg (DE); Andreas Lindenmaier, Steinen (DE)

(73) Assignee: BASF SE, Ludwigshafen (DE)

( * ) Notice: Subject to any disclaimer, the term of this patent is extended or adjusted under 35 U.S.C. 154(b) by 0 days.

(21) Appl. No.: 14/383,926

(22) PCT Filed: Apr. 2, 2013

(86) PCT No.: PCT/EP2013/056891

§ 371 (c)(1),
(2) Date: Sep. 9, 2014

(87) PCT Pub. No.: WO2013/150000

PCT Pub. Date: Oct. 10, 2013

(65) Prior Publication Data

US 2015/0031590 A1 Jan. 29, 2015

Related U.S. Application Data

(60) Provisional application No. 61/619,435, filed on Apr. 3, 2012.

(30) Foreign Application Priority Data

Apr. 3, 2012 (EP) ..... 12162946

(51) Int. Cl.

| | |
|---|---|
| ***C11D 1/02*** | (2006.01) |
| ***C11D 3/395*** | (2006.01) |
| ***C11D 3/40*** | (2006.01) |
| ***C11D 3/37*** | (2006.01) |
| ***C11D 3/16*** | (2006.01) |
| ***C11D 3/39*** | (2006.01) |
| ***C11D 17/06*** | (2006.01) |
| ***C11D 3/00*** | (2006.01) |

(52) U.S. Cl.
CPC ..... *C11D 3/3776* (2013.01); *C11D 3/0063* (2013.01); *C11D 3/168* (2013.01); *C11D 3/3932* (2013.01); *C11D 17/06* (2013.01)

(58) Field of Classification Search
CPC ..... C11D 17/065; C11D 11/0017; C11D 1/02; C11D 3/0063; C11D 3/3753; C11D 3/3917; C11D 3/392; C11D 3/395; C11D 3/3951; C11D 3/3955; C11D 3/40; C11D 9/444
See application file for complete search history.

(56) References Cited

U.S. PATENT DOCUMENTS

| | | | | |
|---|---|---|---|---|
| 5,710,118 | A | 1/1998 | Busch et al. | |
| 5,912,221 | A * | 6/1999 | Van Leeuwen | C11D 3/3792 510/309 |
| 6,288,016 | B1 * | 9/2001 | Ramanan | C11D 1/83 510/357 |
| 6,291,412 | B1 | 9/2001 | Kvita et al. | |
| 2009/0156454 | A1 * | 6/2009 | Schmiedel | C11D 3/38672 510/302 |

FOREIGN PATENT DOCUMENTS

| | | |
|---|---|---|
| EP | 0959123 | 11/1999 |
| GB | 2287949 | 10/1995 |
| GB | 2329397 | 3/1999 |
| WO | 0164824 | 9/2001 |

* cited by examiner

*Primary Examiner* — Charles Boyer
(74) *Attorney, Agent, or Firm* — Marshall, Gerstein & Borun LLP

(57) ABSTRACT

The present invention relates to compositions comprising granules of phthalocyanine compounds, to a process for the preparation thereof, and to the use thereof in washing agent and additive formulations. The composition comprises a) At least one water-soluble phthalocyanine compound; b) At least one cross-linked polyvinylpyrrolidone component; c) At least one hydrophilic binding agent; and, optionally, d) Further additives suitable for the preparation of solid agglomerates; and may be liquid, solid, paste-like or gel-like.

16 Claims, No Drawings

PHTHALOCYANINE-CONTAINING GRANULES TO DECREASE PHTHALOCYANINE DEPOSITION ON TEXTILES

The present invention relates to compositions comprising granules of phthalocyanine compounds, to a process for the preparation thereof, and to the use thereof in washing agent and washing agent additive formulations.

Water-soluble phthalocyanine complex compounds especially zinc and aluminium phthalocyanine sulphonates are frequently used as photo-activators in washing agent preparations.

A problem is seen in the fact that such photo-activators, despite their water-solubility, dissolve too slowly in water. Especially, in the event of inadequate mixing of the washing liquor, coloured photo-activators tend to stain the laundry.

It has now been found that the rate at which agglomerates, particularly granules, of phthalocyanine compounds dissolve in water can be improved by the addition of disintegrants, such as cross-linked polyvinylpyrrolidone.

Therefore, the invention relates to a composition, which comprises a) At least one water-soluble phthalocyanine compound;
b) At least one cross-linked polyvinylpyrrolidone component;
c) At least one hydrophilic binding agent; and, optionally,
d) Further additives suitable for the preparation of solid agglomerates.

The compositions according to the invention may be liquid, solid, paste-like or gel-like. The compositions, especially washing agent compositions but also washing agent additives or additive concentrates, for example pre- and/or after-treatment agents, stain-removing salt, washing-power enhancers, fabric conditioners, bleaching agents, UV-protection enhancers etc., may be in any known and customary form, especially in the form of powders, (super-)compact powders, in the form of single- or multi-layer tablets (tabs), bars, blocks, sheets or pastes, or in the form of pastes, gels or liquids used in capsules or in pouches (sachets). Powders may also be used in suitable sachets or pouches.

A preferred embodiment of the invention relates to a composition, which comprises a) 0.1-20.0 wt.-% of a water-soluble phthalocyanine compound;
b) 0.5-40.0 wt.-% of a cross-linked polyvinylpyrrolidone component
c) 3.0-40.0 wt.-% of a hydrophilic binding agent; and, optionally,
d) 5.0-95.0 wt.-% of further additives suitable for the preparation of solid agglomerates, and
e) 3.0-15.0 wt.-% of water;

Provided that the sum of components a), b), c), d) and e) amounts up to 100 wt.-%.

A particularly preferred embodiment of the invention relates to composition, which comprises a) 0.1-10.0 wt.-% of a water-soluble phthalocyanine compound;
b) 0.5-30.0 wt.-% of a cross-linked polyvinylpyrrolidone component;
c) 3.0-20.0 wt.-% of a hydrophilic binding agent; and, optionally,
d) 20.0-90.0 wt.-% of further additives suitable for the preparation of solid agglomerates, and
e) 3.0-15.0 wt.-% of water;

Provided that the sum of components a), b), c), d) and e) amounts up to 100 wt.-%.

Suitable phthalocyanine compounds are water-soluble or at least water-dispersible phthalocyanine complex compounds with di-, tri- or tetra-valent coordination centres, particularly metal ions (complexes having a $d^0$ or $d^{10}$ configuration), as the central atom, to which the substituent of at least one mono-azo dye is attached.

Such phthalocyanine complex compounds correspond to the formula $$(PC)\text{-}L\text{-}(D) \qquad (1),$$

to which the substituent of at least one mono-azo dye is attached by the linking group L, Wherein PC represents the Zn(II), Fe(II), Ca(II), Mg(II), Na(I), K(I), Al(III), Si(IV), P(V), Ti(IV) or Cr(VI) metal-containing phthalocyanine structure;

D represents the substituent of a mono-azo dye; and

L represents a group,

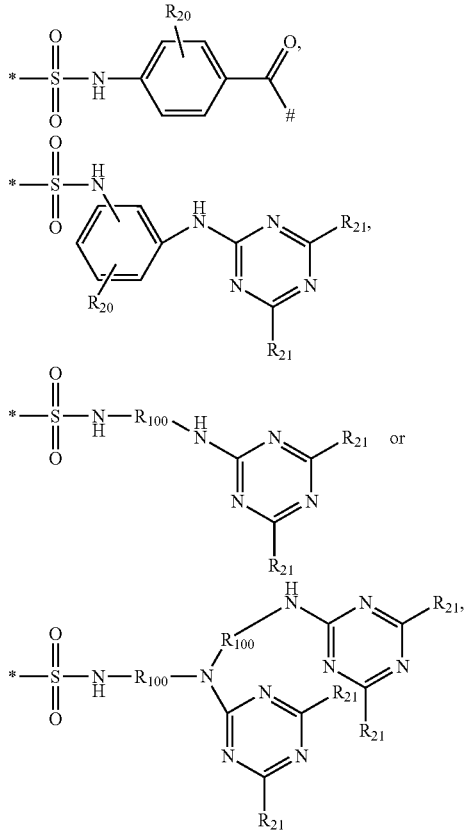

Wherein $R_{20}$ represents hydrogen, $C_1$-$C_8$alkyl, $C_1$-$C_8$alkoxy or halogen;

$R_{21}$ represents D, hydrogen, OH, Cl or F, provided that at least one of $R_{21}$ is D;

$R_{100}$ represents $C_1$-$C_8$alkylene;

* marks the point of attachment of PC; and # marks the point of attachment of the substituent D of the mono-azo dye.

$C_1$-$C_8$alkyl is linear or branched alkyl, for example methyl, ethyl, propyl, butyl, pentyl, hexyl, heptyl, octyl or isopropyl.

$C_1$-$C_8$alkoxy is linear or branched, for example methoxy, propoxy or octyloxy.

Halogen is F, C, Br or I, preferably Cl.

$C_1$-$C_8$alkylene is, for example, linear or branched methylene, ethylene, propylene, butylene or pentylene.

The phthalocyanine complex compound of the formula (1), wherein the phthalocyanine backbone is substituted by at least one sulpho groups and to which the substituent of at least one mono-azo dye is attached by the linking group L, are characterized by rapid photo degradation, which has the effect that discolouration on the treated fabric is avoided, even after repeated treatment. The phthalocyanine complex compounds of the formula (1) are characterized by improved shading and exhaustion onto the fabrics. The phthalocyanine complex compounds of the formula (1) are also highly efficient photo catalysts by additional light absorption and energy transfer to the phthalocyanine part of the molecule.

According to a preferred embodiment the water-soluble phthalocyanine complex compound (1) corresponds to the formula (1a)

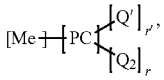

Wherein

PC represents the phthalocyanine structure;

Me represents the central metal atom or central metal group coordinated to PC, which is selected from the group consisting of Zn, Fe, Ca, Mg, Na, K, Al—$Z_1$, Si(IV)-$(Z_1)_2$, Ti(IV)-$(Z_1)_2$ and Sn(IV)-$(Z_1)_2$;

$Z_1$ represents $C_1$-$C_8$alkanolate, $OH^-$, $R_0COO^-$, $ClO_4^-$, $BF_4^-$, $PF_6^-$, $R_0SO_3^-$, $SO_4^{2-}$, $NO_3^-$, $F^-$, $Cl^-$, $Br^-$, $I^-$, citrate, tartrate or oxalate, wherein $R_0$ is hydrogen or $C_1$-$C_{18}$alkyl;

r represents 0 or a numeral from 1 to 3, preferably 1 to 2;

r' represents a numeral from 1 to 3, preferably 1 to 3;

each $Q_2$ independently of one another represents —$SO_3^-M^+$ or the group —$(CH_2)_m$—COO $M^+$; wherein $M^+$ is $H^+$, an alkali metal ion or the ammonium ion and m is 0 or a numeral from 1 to 12;

each Q' independently of one another represents the segment of the partial formula -L-D, Wherein D represents the substituent of a mono-azo dye; and L represents a group

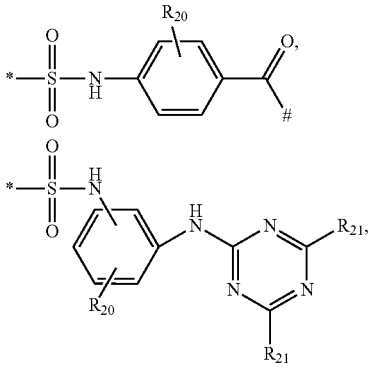

-continued

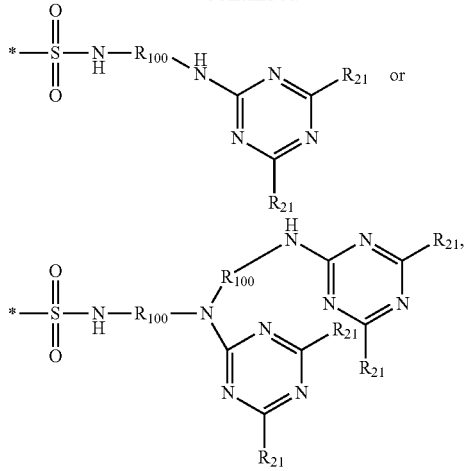

Wherein $R_{20}$ represents hydrogen, $C_1$-$C_8$alkyl, $C_1$-$C_8$alkoxy or halogen;

$R_{21}$ represents D, hydrogen, OH, Cl or F, provided that at least one is D;

$R_{100}$ represents $C_1$-$C_8$alkylene;

* marks the point of attachment of Me-PC; and # marks the point of attachment of the substituent D of the mono-azo dye.

In the phthalocyanine complex compound that corresponds to the formula (1a) of above, the sum of r and r' is preferably from 1-4.

Me represents the central metal atom or central metal group coordinated to PC, which is selected from the group consisting of Zn, Al—$Z_1$ and Ti(IV)-$(Z_1)_2$, wherein $Z_1$ is as defined above, preferably halogen, e.g. chlorine, or hydroxy.

Me preferably represents Zn.

According to a preferred embodiment the water-soluble phthalocyanine complex compound (1) corresponds to the formula (2a)

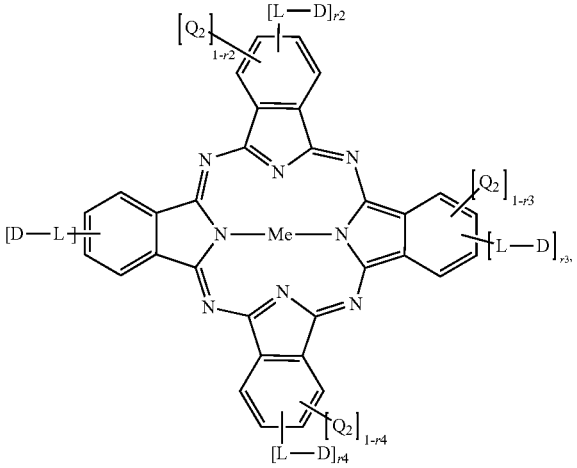

Wherein

Me represents Zn, Al—$Z_1$, Si(IV)-$(Z_1)_2$ or Ti(IV)-$(Z_1)_2$, wherein $Z_1$ is chloride, fluoride, bromide, hydroxide or $C_1$-$C_4$alkoxide;

each $Q_2$ independently of one another represents —$SO_3^-$ $M^+$ or the group —$(CH_2)_m$—COO $M^+$, wherein $M^+$ is $H^+$, an alkali metal ion or the ammonium ion and m is 0 or a numeral from 1 to 12;

D represents the substituent of a mono-azo dye; and

L represents a group

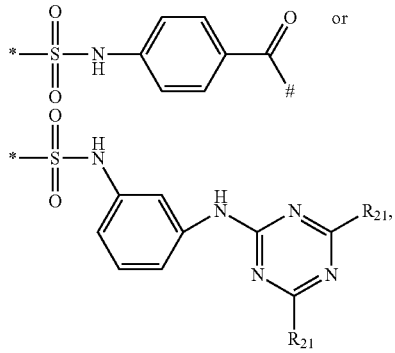

Wherein $R_{21}$ represents D, hydrogen, OH, Cl or F, provided that at least one of $R_{21}$ is D, preferably two of $R_{21}$ are D;

* marks the point of attachment of PC;

# marks the point of attachment to D;

$r_2$ represents 0 or 1;

$r_3$ represents 0 or 1; and $r_4$ represents 0 or 1.

According to a preferred embodiment, the groups D, independently of one another, represent the substituents of a mono-azo dye of the partial formulae Xa, Xb, Xc or Xd:

(Xa)

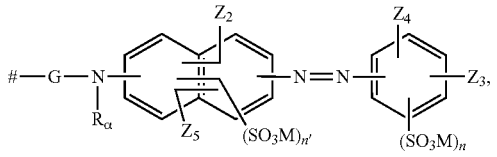

(Xb)

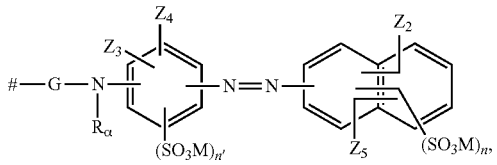

(Xc)

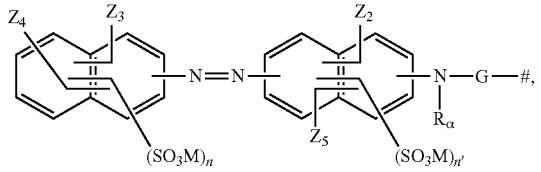

(Xd)

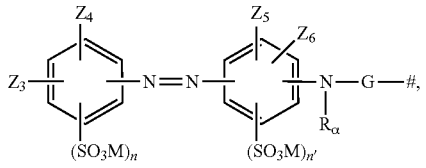

Wherein # marks the point of attachment of the bridging group L;

$R_\alpha$ represents hydrogen, $C_1$-$C_4$alkyl, $C_1$-$C_2$alkyl which is substituted by at least one substituent selected from the group consisting of hydroxy, cyano, $SO_3H$, $NH_2$, carboxy, $C_1$-$C_4$alkoxycarbonyl, $C_1$-$C_4$alkoxy, phenyl, naphthyl and pyridyl, straight chain or branched $C_3$-$C_4$-alkyl which is substituted by at least one substituent selected from the group consisting of hydroxy, cyano, $SO_3H$, $NH_2$, carboxy, $C_1$-$C_4$alkoxycarbonyl, $C_1$-$C_4$alkoxy, phenyl, naphthyl and pyridyl, aryl, aryl which is substituted by at least one substituent selected from the group consisting of hydroxy, cyano, $SO_3H$, $NH_2$, carboxy, $C_1$-$C_4$alkoxycarbonyl, $C_1$-$C_4$alkoxy and $C_1$-$C_4$alkyl;

$Z_2$, $Z_3$, $Z_4$, $Z_5$ and $Z_6$ independently of one another represent hydrogen, hydroxy, $C_1$-$C_4$alkyl, $C_1$-$C_2$alkyl which is substituted by at least one substituent selected from the group consisting of hydroxy, cyano, $SO_3H$, $NH_2$, carboxy, $C_1$-$C_4$alkoxycarbonyl, $C_1$-$C_4$alkoxy, phenyl, naphthyl and pyridyl, straight chain or branched $C_3$-$C_4$-alkyl which is substituted by at least one substituent selected from the group consisting of hydroxy, cyano, $SO_3H$, $NH_2$, carboxy, $C_1$-$C_4$alkoxycarbonyl, $C_1$-$C_4$alkoxy, phenyl, naphthyl and pyridyl, $C_1$-$C_4$alkoxy, $C_1$-$C_2$alkoxy which is substituted by at least one substituent selected from the group consisting of hydroxy, cyano, $SO_3H$, $NH_2$, carboxy, $C_1$-$C_4$alkoxycarbonyl, $C_1$-$C_4$alkoxy, phenyl, naphthyl and pyridyl, straight chain or branched $C_3$-$C_4$-alkoxy which is substituted by at least one substituent selected from the group consisting of hydroxy, cyano, $SO_3H$, $NH_2$, carboxy, $C_1$-$C_4$alkoxycarbonyl, $C_1$-$C_4$alkoxy, phenyl, naphthyl and pyridyl, halogen, —$SO_2CH_2CH_2SO_3H$, $NO_2$, COOH, —$COOC_1$-$C_4$alkyl, $NH_2$, $NHC_1$-$C_4$alkyl, wherein the alkyl group may be substituted by at least one substituent selected from the group consisting of OH, $NH_2$, $C_1$-$C_4$alkyl, CN and COOH, $N(C_1$-$C_4$alkyl$)C_1$-$C_4$alkyl, wherein the alkyl groups may independently of one another be substituted by at least one substituent selected from the group consisting of OH, $NH_2$, $C_1$-$C_4$alkyl, CN and COOH, NH-aryl, NH-aryl, wherein aryl is substituted by at least one substituent selected from the group consisting of hydroxy, cyano, $SO_3H$, $NH_2$, carboxy, $C_1$-$C_4$alkoxycarbonyl, $C_1$-$C_4$alkyl and $C_1$-$C_4$alkoxy, or represents $NHCOC_1$-$C_4$alkyl or $NHCOOC_1$-$C_4$alkyl;

G represents the direct bond, —$COOC_1$-$C_4$alkylene, arylene; arylene which is substituted by at least one substituent selected from the group consisting of hydroxy, cyano, $NO_2$, $SO_3H$, $NH_2$, carboxy, $C_1$-$C_4$alkoxycarbonyl, $C_1$-$C_4$alkoxy and $C_1$-$C_4$alkyl, $C_1$-$C_4$alkylene, $C_1$-$C_4$-alkylene substituted by at least one substituent selected from the group consisting of hydroxy, cyano, $NO_2$, $SO_3H$, $NH_2$, carboxy, $C_1$-$C_4$alkoxycarbonyl, $C_1$-$C_4$alkoxy and $C_1$-$C_4$alkyl, or represents —CO-arylene;

n represents 0; 1; 2 or 3;

n' represents 0; 1 or 2; and each M independently of one another represents hydrogen; an alkali metal ion or an ammonium ion.

The substituents in the naphthyl groups, in the event they are not attached in a fixed position to an individual carbon atom, can be attached in either ring of the naphthyl radical.

This is expressed by the horizontal line going through both rings in, for example, in structural formula Xa, Xb and Xc.

For example $C_1$-$C_4$alkylene is methylene, ethylene, propylene or butylene.

Arylene in the context of the description of the instant invention means phenylene or naphthylene, preferably phenylene.

According to a preferred embodiment, the groups D, independently of one another, represent the substituents of a mono-azo dye of the partial formulae XIa, XIb, XIc or XId:

(XIa)

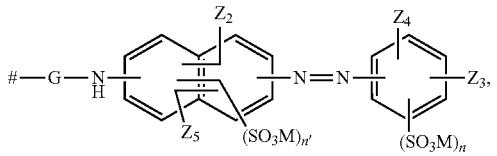

Wherein # marks the point of attachment of the bridging group L;

$Z_2$ represents $C_1$-$C_2$-alkyl, $C_1$-$C_2$-alkyl which is substituted by at least one substituent selected from the group consisting of hydroxy, cyano, $SO_3H$, $NH_2$, carboxy, $C_1$-$C_2$alkoxycarbonyl, $C_1$-$C_2$alkoxy, phenyl, naphthyl and pyridyl, $C_1$-$C_2$-alkoxy, $C_1$-$C_2$-alkoxy which is substituted by at least one substituent selected from the group consisting of hydroxy, cyano, $SO_3H$, $NH_2$, carboxy, $C_1$-$C_2$alkoxycarbonyl, $C_1$-$C_2$alkyl, phenyl, naphthyl and pyridyl, or represents OH;

$Z_3$ represents hydrogen, $C_1$-$C_2$-alkyl, $C_1$-$C_2$-alkyl which is substituted by at least one substituent selected from the group consisting of hydroxy, cyano, $SO_3H$, $NH_2$, carboxy, $C_1$-$C_2$alkoxycarbonyl, $C_1$-$C_2$alkoxy, phenyl, naphthyl and pyridyl, $C_1$-$C_2$-alkoxy, $C_1$-$C_2$-alkoxy which is substituted by at least one substituent selected from the group consisting of hydroxy, cyano, $SO_3H$, $NH_2$, carboxy, $C_1$-$C_2$alkoxycarbonyl, $C_1$-$C_2$alkyl, phenyl, naphthyl and pyridyl, OH, $NO_2$, $NH_2$, $NHC_1$-$C_2$alkyl, wherein the alkyl group may be substituted by at least one substituent selected from the group consisting of OH, $NH_2$, $C_1$-$C_2$alkyl, CN and COOH, or represents $NHCOC_1$-$C_2$alkyl or $NHCOOC_1$-$C_2$alkyl;

$Z_4$ represents hydrogen, $C_1$-$C_2$-alkyl, $C_1$-$C_2$-alkyl which is substituted by at least one substituent selected from the group consisting of hydroxy, cyano, $SO_3H$, $NH_2$, carboxy, $C_1$-$C_2$alkoxycarbonyl, $C_1$-$C_2$alkoxy, phenyl, naphthyl and pyridyl, $C_1$-$C_2$alkoxy, $C_1$-$C_2$alkoxy which is substituted by at least one substituent selected from the group consisting of hydroxy, cyano, $SO_3H$, $NH_2$, carboxy, $C_1$-$C_4$alkoxycarbonyl, $C_1$-$C_4$alkyl, phenyl, naphthyl and pyridyl, OH, $NO_2$, $NH_2$, $NHC_1$-$C_2$alkyl, wherein the alkyl group may be substituted by at least one substituent selected from the group consisting of OH, $NH_2$, $C_1$-$C_2$alkyl, CN and COOH, or represents $NHCOC_1$-$C_2$alkyl or $NHCOOC_1$-$C_2$alkyl;

$Z_5$ represents hydrogen, $C_1$-$C_2$-alkyl, $C_1$-$C_2$-alkyl which is substituted by at least one substituent selected from the group consisting of hydroxy, cyano, $SO_3H$, $NH_2$, carboxy, $C_1$-$C_2$alkoxycarbonyl, $C_1$-$C_2$alkoxy, phenyl, naphthyl and pyridyl;

G represents the direct bond, $COOC_1$-$C_2$alkylene, arylene, arylene which is substituted by at least one substituent selected from the group consisting of hydroxy, cyano, $NO_2$, $SO_3H$, $NH_2$, carboxy, $C_1$-$C_2$alkoxycarbonyl, $C_1$-$C_2$alkoxy and $C_1$-$C_2$alkyl, $C_1$-$C_2$alkylene or $C_1$-$C_2$-alkylene which is substituted by at least one substituent selected from the group consisting of hydroxy, cyano, $NO_2$, $SO_3H$, $NH_2$, carboxy, $C_1$-$C_2$alkoxycarbonyl, $C_1$-$C_2$alkoxy and $C_1$-$C_2$alkyl;

n represents 0, 1, 2 or 3;

n' represents 0, 1 or 2; and each M independently of one another represents hydrogen, $Na^+$ or $K^+$;

(XIb)

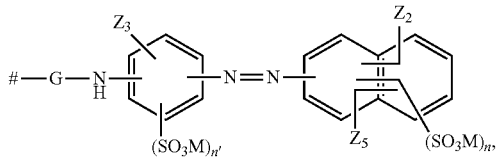

Wherein # marks the point of attachment of the bridging group L;

$Z_2$ represents $C_1$-$C_2$-alkyl, $C_1$-$C_2$-alkyl which is substituted by at least one substituent selected from the group consisting of hydroxy, cyano, $SO_3H$, $NH_2$, carboxy, $C_1$-$C_2$alkoxycarbonyl, $C_1$-$C_2$alkoxy, phenyl, naphthyl and pyridyl, $C_1$-$C_2$-alkoxy, $C_1$-$C_2$-alkoxy which is substituted by at least one substituent selected from the group consisting of hydroxy, cyano, $SO_3H$, $NH_2$, carboxy, $C_1$-$C_2$alkoxycarbonyl, $C_1$-$C_2$alkyl, phenyl, naphthyl and pyridyl or represents OH;

$Z_3$ is hydrogen, $C_1$-$C_2$-alkyl, $C_1$-$C_2$-alkyl which is substituted by at least one substituent selected from the group consisting of hydroxy, cyano, $SO_3H$, $NH_2$, carboxy, $C_1$-$C_2$alkoxycarbonyl, $C_1$-$C_2$alkoxy, phenyl, naphthyl and pyridyl, $C_1$-$C_2$-alkoxy, $C_1$-$C_2$-alkoxy which is substituted by at least one substituent selected from the group consisting of hydroxy, cyano, $SO_3H$, $NH_2$, carboxy, $C_1$-$C_2$alkoxycarbonyl, $C_1$-$C_2$alkyl, phenyl, naphthyl and pyridyl, OH, $NO_2$, $NH_2$, $NHC_1$-$C_2$alkyl, wherein the alkyl group may be substituted by at least one substituent selected from the group consisting of OH, $NH_2$, $C_1$-$C_2$alkyl, CN or COOH or represents $NHCOC_1$-$C_2$alkyl or $NHCOOC_1$-$C_2$alkyl;

$Z_5$ represents hydrogen, $C_1$-$C_2$-alkyl or $C_1$-$C_2$-alkyl which is substituted by at least one substituent selected from the group consisting of hydroxy, cyano, $SO_3H$, $NH_2$, carboxy, $C_1$-$C_2$alkoxycarbonyl, $C_1$-$C_2$alkoxy, phenyl, naphthyl and pyridyl;

G represents the direct bond, $COOC_1$-$C_2$alkylene, arylene, arylene which is substituted by at least one substituent selected from the group consisting of hydroxy, cyano, $NO_2$, $SO_3H$, $NH_2$, carboxy, $C_1$-$C_2$alkoxycarbonyl, $C_1$-$C_2$alkoxy and $C_1$-$C_2$alkyl, $C_1$-$C_2$alkylene or $C_1$-$C_2$-alkylene which is substituted by at least one substituent selected from the group consisting of hydroxy, cyano, $NO_2$, $SO_3H$, $NH_2$, carboxy, $C_1$-$C_2$alkoxycarbonyl, $C_1$-$C_2$alkoxy and $C_1$-$C_2$alkyl;

n represents 0, 1, 2 or 3;

n' is 0, 1 or 2; and each M independently of one another represents hydrogen, $Na^+$ or $K^+$;

(XIc)

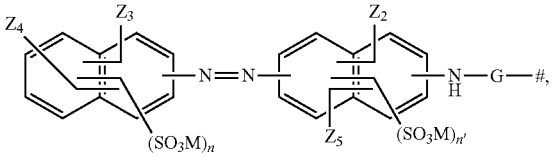

Wherein # marks the point of attachment of the bridging group L;

$Z_2$ represents hydrogen, hydroxy, $C_1$-$C_2$-alkyl, $C_1$-$C_2$-alkyl which is substituted by at least one substituent selected from the group consisting of hydroxy, cyano, $SO_3H$, $NH_2$, carboxy, $C_1$-$C_2$alkoxycarbonyl, $C_1$-$C_2$alkoxy, phenyl, naphthyl and pyridyl, $C_1$-$C_2$-alkoxy or $C_1$-$C_2$-alkoxy which is substituted by at least one substituent selected from the group consisting of hydroxy, cyano, $SO_3H$, $NH_2$, carboxy, $C_1$-$C_4$alkoxycarbonyl, $C_1$-$C_4$alkyl, phenyl, naphthyl and pyridyl, or represents $NO_2$;

$Z_3$ represents hydrogen, $C_1$-$C_2$-alkyl, $C_1$-$C_2$-alkyl which is substituted by at least one substituent selected from the group consisting of hydroxy, cyano, $SO_3H$, $NH_2$, carboxy, $C_1$-$C_2$alkoxycarbonyl, $C_1$-$C_2$alkoxy, phenyl, naphthyl and pyridyl, $C_1$-$C_2$-alkoxy, $C_1$-$C_2$-alkoxy which is substituted by at least one substituent selected from the group consisting of hydroxy, cyano, $SO_3H$, $NH_2$, carboxy, $C_1$-$C_2$alkoxycarbonyl, $C_1$-$C_2$alkyl, phenyl, naphthyl and pyridyl, OH, $NO_2$, $NH_2$, $NHC_1$-$C_2$alkyl, wherein the alkyl group may be substituted by at least one substituent selected from the group consisting of OH, $NH_2$, $C_1$-$C_2$alkyl, CN and COOH, or represents $NHCOC_1$-$C_2$alkyl or $NHCOOC_1$-$C_2$alkyl;

$Z_4$ represents hydrogen, $C_1$-$C_2$-alkyl, $C_1$-$C_2$-alkyl which is substituted by at least one substituent selected from the group consisting of hydroxy, cyano, $SO_3H$, $NH_2$, carboxy, $C_1$-$C_2$alkoxycarbonyl, $C_1$-$C_2$alkoxy, phenyl, naphthyl and pyridyl, $C_1$-$C_2$-alkoxy or $C_1$-$C_2$-alkoxy which is substituted by at least one substituent selected from the group consisting of hydroxy, cyano, $SO_3H$, $NH_2$, carboxy, $C_1$-$C_4$alkoxycarbonyl, $C_1$-$C_4$alkyl, phenyl, naphthyl and pyridyl, OH, $NO_2$, $NH_2$, $NHC_1$-$C_2$alkyl, wherein the alkyl group may be substituted by at least one substituent selected from the group consisting of OH, $NH_2$, $C_1$-$C_2$alkyl, CN and COOH, or represents $NHCOC_1$-$C_2$alkyl or $NHCOOC_1$-$C_2$alkyl;

$Z_5$ represents hydrogen, $C_1$-$C_2$-alkyl, $C_1$-$C_2$-alkyl which is substituted by at least one substituent selected from the group consisting of hydroxy, cyano, $SO_3H$, $NH_2$, carboxy, $C_1$-$C_2$alkoxycarbonyl, $C_1$-$C_2$alkoxy, phenyl, naphthyl and pyridyl, $C_1$-$C_2$-alkoxy, $C_1$-$C_2$-alkoxy, which is substituted by at least one substituent selected from the group consisting of hydroxy, cyano, $SO_3H$, $NH_2$, carboxy, $C_1$-$C_4$alkoxycarbonyl, $C_1$-$C_4$alkyl, phenyl, naphthyl and pyridyl, or represents $NO_2$;

G represents the direct bond, $COOC_1$-$C_2$alkylene, arylene, arylene which is substituted by at least one substituent selected from the group consisting of hydroxy, cyano, $NO_2$, $SO_3H$, $NH_2$, carboxy, $C_1$-$C_2$alkoxycarbonyl, $C_1$-$C_2$alkoxy and $C_1$-$C_2$alkyl, $C_1$-$C_2$alkylene or $C_1$-$C_2$-alkylene which is substituted by at least one substituent selected from the group consisting of hydroxy, cyano, $NO_2$, $SO_3H$, $NH_2$, carboxy, $C_1$-$C_2$alkoxycarbonyl, $C_1$-$C_2$alkoxy and $C_1$-$C_2$alkyl;

n represents 0, 1, 2 or 3;

n' represents 0, 1 or 2; and each M independently of one another represents $Na^+$ or $K^+$;

(XId)

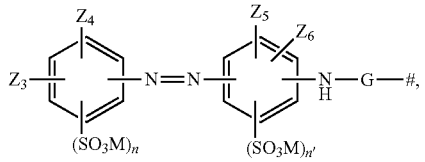

Wherein # marks the point of attachment of the bridging group L;

$Z_3$ represents hydrogen, $C_1$-$C_2$-alkyl, $C_1$-$C_2$-alkyl which is substituted by at least one substituent selected from the group consisting of hydroxy, cyano, $SO_3H$, $NH_2$, carboxy, $C_1$-$C_2$alkoxycarbonyl, $C_1$-$C_2$alkoxy, phenyl, naphthyl and pyridyl, $C_1$-$C_2$-alkoxy, $C_1$-$C_2$-alkoxy which is substituted by at least one substituent selected from the group consisting of hydroxy, cyano, $SO_3H$, $NH_2$, carboxy, $C_1$-$C_4$alkoxycarbonyl, $C_1$-$C_4$alkyl, phenyl, naphthyl and pyridyl, or represents $SO_2CH_2CH_2SO_3H$ or $NO_2$;

$Z_4$ represents $C_1$-$C_2$-alkyl, $C_1$-$C_2$-alkyl which is substituted by at least one substituent selected from the group consisting of hydroxy, cyano, $SO_3H$, $NH_2$, carboxy, $C_1$-$C_2$alkoxycarbonyl, $C_1$-$C_2$alkoxy, phenyl, naphthyl and pyridyl, $C_1$-$C_2$-alkoxy, $C_1$-$C_2$-alkoxy which is substituted by at least one substituent selected from the group consisting of hydroxy, cyano, $SO_3H$, $NH_2$, carboxy, $C_1$-$C_4$alkoxycarbonyl, $C_1$-$C_4$alkyl, phenyl, naphthyl and pyridyl, OH, or represents $SO_2CH_2CH_2SO_3H$, or $NO_2$;

$Z_5$ represents hydrogen, $C_1$-$C_2$-alkyl, $C_1$-$C_2$-alkyl which is substituted by at least one substituent selected from the group consisting of hydroxy, cyano, $SO_3H$, $NH_2$, carboxy, $C_1$-$C_2$alkoxycarbonyl, $C_1$-$C_2$alkoxy, phenyl, naphthyl and pyridyl, $C_1$-$C_2$-alkoxy, $C_1$-$C_2$-alkoxy which is substituted by at least one substituent selected from the group consisting of hydroxy, cyano, $SO_3H$, $NH_2$, carboxy, $C_1$-$C_4$alkoxycarbonyl, $C_1$-$C_4$alkyl, phenyl, naphthyl and pyridyl, OH, $NO_2$, $NH_2$, $NHC_1$-$C_2$alkyl, wherein the alkyl group may be substituted by at least one substituent selected from the group consisting of OH, $NH_2$, $C_1$-$C_2$alkyl, CN and COOH, or represents $NHCOC_1$-$C_2$alkyl or $NHCOOC_1$-$C_2$alkyl;

$Z_6$ represents $C_1$-$C_2$-alkyl, $C_1$-$C_2$-alkyl which is substituted by at least one substituent selected from the group consisting of hydroxy, cyano, $SO_3H$, $NH_2$, carboxy, $C_1$-$C_2$alkoxycarbonyl, $C_1$-$C_2$alkoxy, phenyl, naphthyl and pyridyl, $C_1$-$C_2$-alkoxy, $C_1$-$C_2$-alkoxy which is substituted by at least one substituent selected from the group consisting of hydroxy, cyano, $SO_3H$, $NH_2$, carboxy, $C_1$-$C_4$alkoxycarbonyl, $C_1$-$C_4$alkyl, phenyl, naphthyl and pyridyl, or represents $NO_2$;

G represents the direct bond, $COOC_1$-$C_2$alkylene, arylene, arylene which is substituted by at least one substituent selected from the group consisting of hydroxy, the cyanophthalocyanine group, $NO_2$, $SO_3H$, $NH_2$, carboxy, $C_1$-$C_2$alkoxycarbonyl, $C_1$-$C_2$alkoxy and $C_1$-$C_2$alkyl, $C_1$-$C_2$alkylene or $C_1$-$C_2$-alkylene which is substituted by at least one substituent selected from the group consisting of hydroxy, cyano, $NO_2$, $SO_3H$, $NH_2$, carboxy, $C_1$-$C_2$alkoxycarbonyl, $C_1$-$C_2$alkoxy and $C_1$-$C_2$alkyl;

n represents 0, 1, 2 or 3;

n' represents 0, 1 or 2; and each M independently of one another represents hydrogen, $Na^+$ or $K^+$.

According to a particularly preferred embodiment, D is selected from the group consisting of compounds, wherein the partial formulae 10, 11, 12, 13 and 14:

(10)

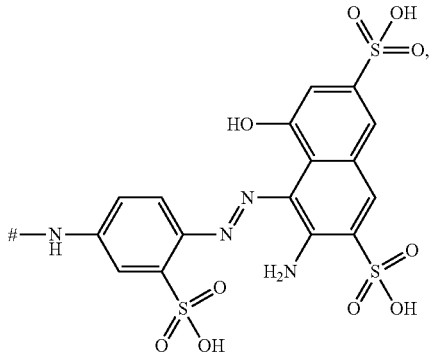

(11)

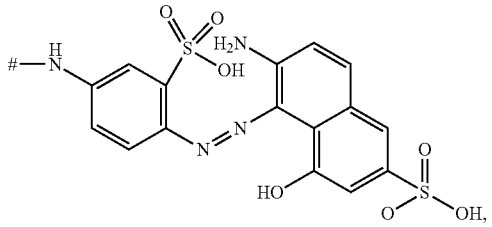

(12)

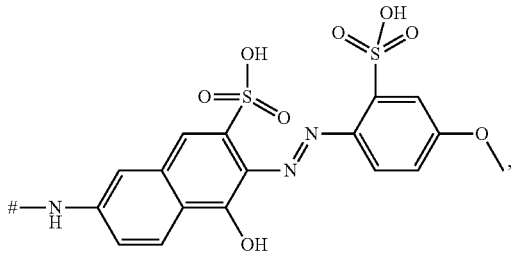

(13)

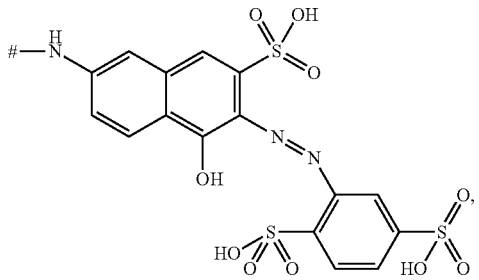

-continued (14)

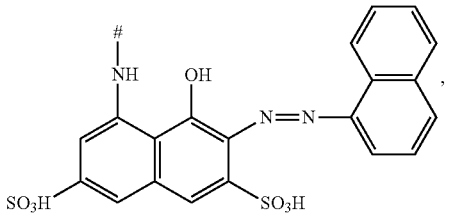

are present and wherein # marks the point of attachment of the bridging group L.

The sulphonic acid groups of the dyes represented by —$SO_3H$ may also be in the form of their salts, in particular of alkali metal salts, such as Na, K or Li salts or as ammonium salts. Also mixtures of the free acid and the corresponding salts are embraced.

A particularly suitable individual phthalocyanine is represented by the following formula wherein the degree of sulphonation is between 1 and 3 in the phthalocyanine structure:

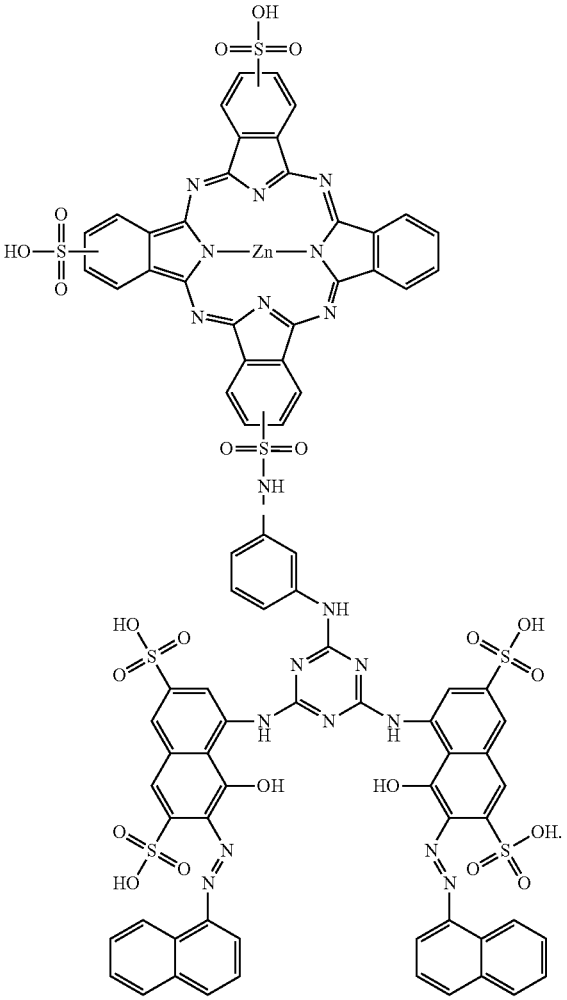

According to another preferred embodiment, the water-soluble phthalocyanine complex compound (1) corresponds to the formula $$[Me\text{—}[PC\text{—}SO_3\text{—}Y_3']_r,\ [L\text{—}D]_{r'}] \quad (3a)$$

Wherein

PC, L and D are as defined above (including the preferences);

Me is Zn or Al—$Z_1$, $Z_1$ is chlorine, fluorine, bromine or hydroxy;

$Y_3'$ is hydrogen; an alkali metal ion or ammonium ion;

r is zero or a numeral from 1-3; and r' is a numeral from 1 to 4.

The amount of water-soluble phthalocyanine complex compounds (1) present in the agglomerates, particularly granules, may vary within wide limits. A preferred range is from about 0.01-20.0 wt.-%, particularly 0.1-20 wt.-%, especially from 0.1-10.0 wt.-%, based on the total weight of the agglomerates.

Lower weight ranges are from about 0.01-0.5 wt.-%, particularly 0.05-0.3 wt.-%, based on the total weight of the agglomerates.

For the synthesis of the water-soluble phthalocyanine complex compounds (1), two different reaction sequences are available: either by initial synthesis of a metal-free phthalocyanine derivative and subsequent complexation with a metal salt or by synthesis of a phthalocyanine ring system from a simple benzenoid precursor by concomitant incorporation of the metal ion.

Substituents can be introduced before or after the formation of the phthalocyanine ring structure.

A suitable method to obtain water-soluble phthalocyanine complex compounds (1) is the introduction of sulphonate groups, for example by sulphonation of the unsubstituted metal phthalocyanine with 1-4 sulpho groups:

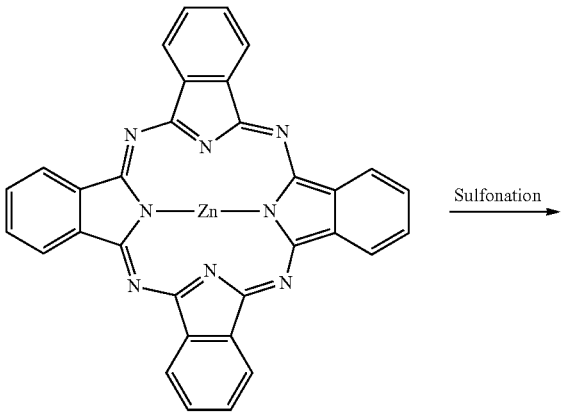

-continued

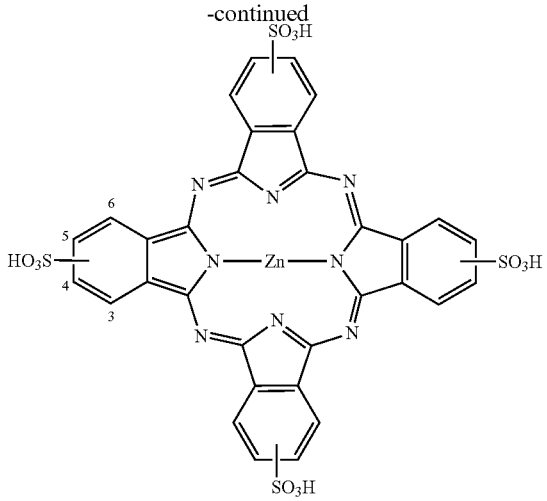

The sulphonated phthalocyanine complex compounds are mixtures of different structure and different positional isomers. The —$SO_3H$-group can be located at positions 3, 4, 5 or 6. Also the degree of sulphonation is varying. For example, a tetra sodium salt of the zinc phthalocyanine can be prepared after known procedure: J. Griffiths et al., *Dyes and Pigments, Vol.* 33, 65-78 (1997) and the literature cited therein.

Another method to obtain a sulphonated metal phthalocyanine is reacting a sulpho phthalic acid with a metal salt, urea and a molybdate catalyst in a melt condensation. The position of the sulphonation is determined by the corresponding phthalic acid reactant. If 4-sulphophthalic acid is used, a tetrasulphonated metal phthalocyanine with sulphonic acid groups exclusively in position 4 or 5 is obtained.

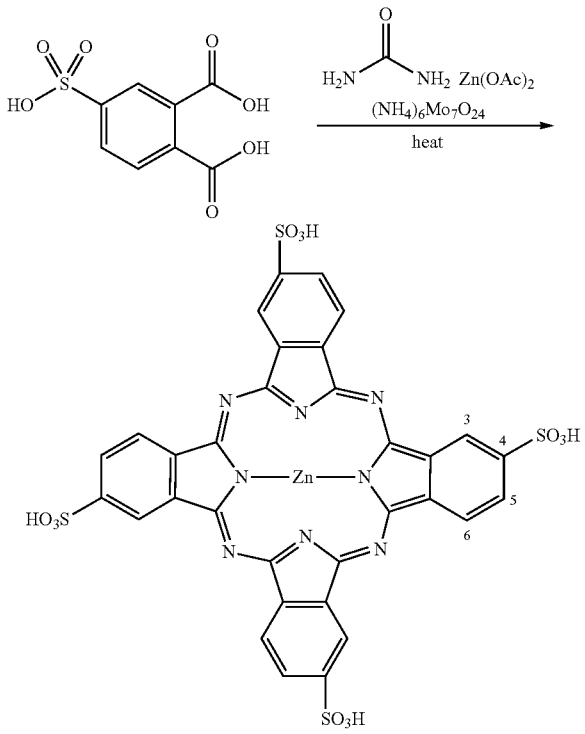

The content of sulphonic acid groups can be adjusted by addition of phthalic acid. With this melt process sulphonated zinc phthalocyanine derivatives having a degree of sulphonation between DS=1-4 can be prepared.

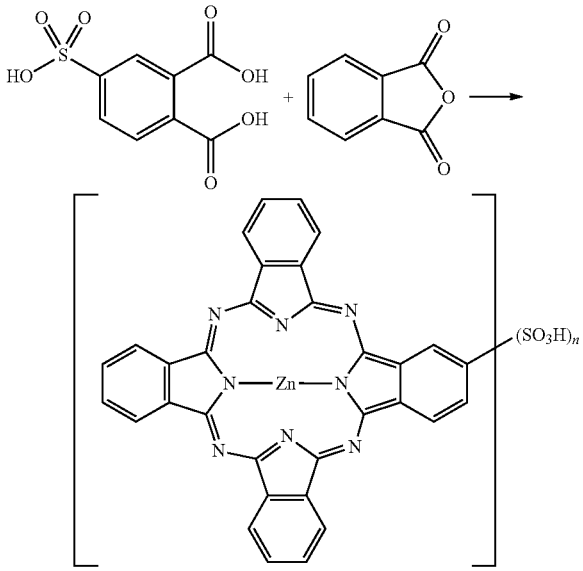

$n = 1, 2, 3, 4$ the compositions according to the present application, the phthalocyanine complex is being linked with a mono-azo dye molecule corresponding to D via specific linking groups L. A convenient way to realize this linkage is the synthesis of a metal phthalocyanine sulphonyl chloride by a sulphochlorination reaction after known procedures (DE 2812261, DE 0153278). By varying the amount of the sulphochlorination agent, the desired degree of sulpho chloride content can be adjusted. The sulphochlorination reaction of phthalocyanines generally leads to a main product, but as by-products small amounts of lower or higher degree of sulphonyl chloride groups are detected.

The resulting reactive phthalocyanine-sulphonyl chloride can then be reacted further with a suitable dye having an amino group. To illustrate the synthesis, the following synthetic examples leading to zinc and aluminium phthalocyanines linked with amino-functionalized azo dyes are given. The syntheses are performed as shown in the following scheme. From the possible positional isomers, only one is shown. The formation of the side products (degree of —$SO_3R$ and $SO_2Cl$) is not shown.

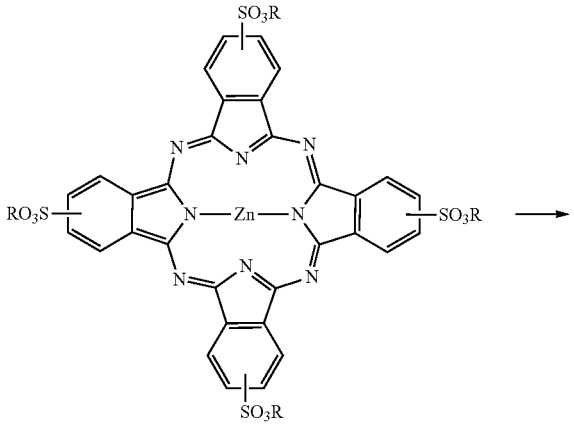

-continued

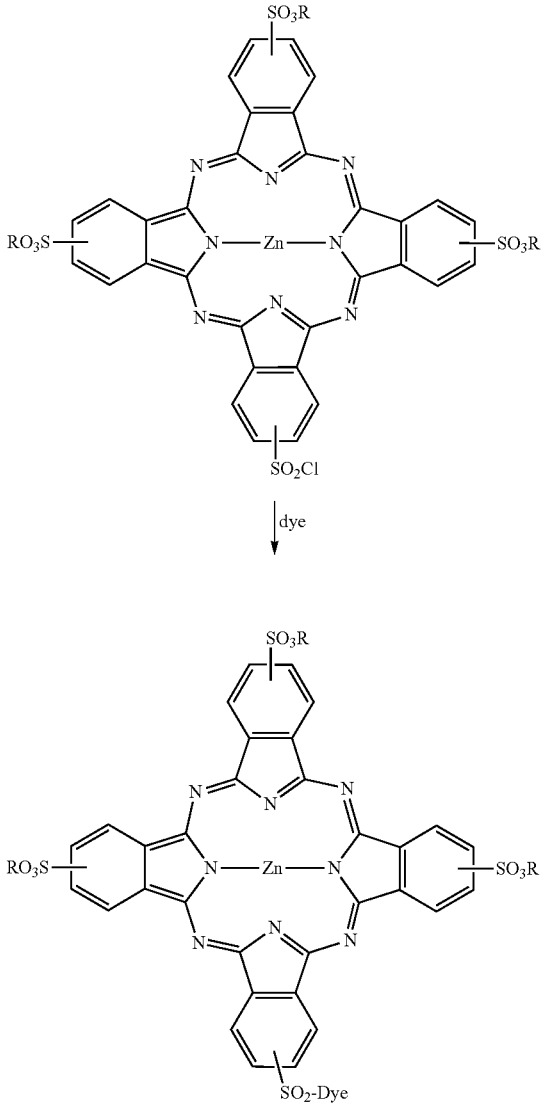

R = H or Na
DS 3-4

The synthesis of zinc phthalocyanine complex compounds with a lower degree of sulphonation and analogous activation and coupling to the corresponding zinc phthalocyanine azo dyes is also possible.

The synthesis of exactly tris-sulphonated zinc phthalocyanine derivatives is known from literature [J. E. van Lier, *Journ. Med. Chem.* (1997), 40 (24) 3897] as a product from ring expansion reaction of boron tri(4-sulpho)sub-phthalocyanine.

The synthesis of metal phthalocyanines with lower degree of sulphonation can also be performed by a modified sulphonation reaction, for example by shortening of reaction time and/or reduction of reaction temperature (WO 2009068513 and WO 2009069077).

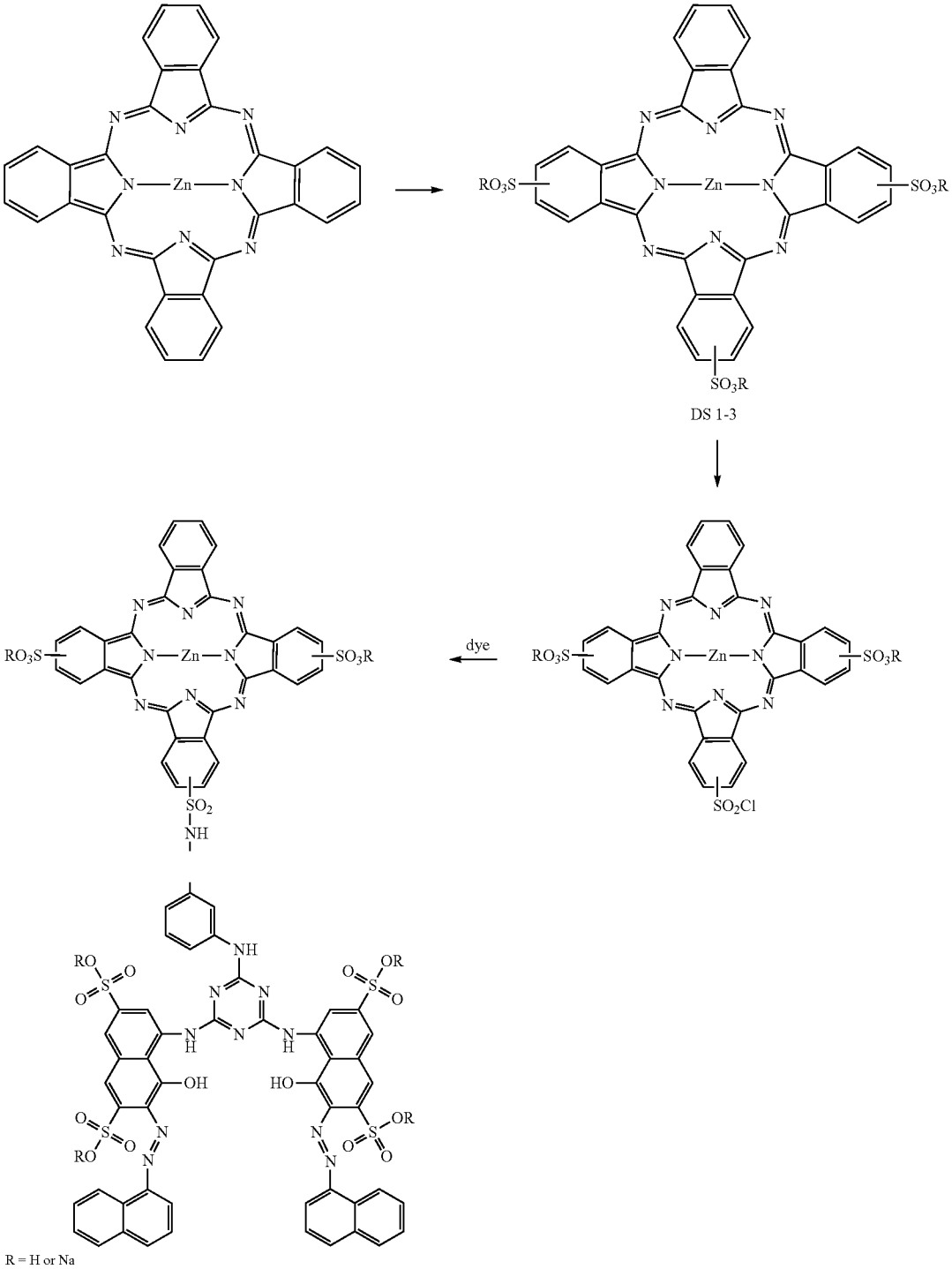

The cross-linked polyvinylpyrrolidone component b) is insoluble in water and in other solvents. The insolubility of cross-linked polyvinylpyrrolidone is used for its quantitative determination in formulations by gravimetry. Suitable products belong to the group of super disintegrants and are known under the generic terms Crospovidone, crospovidonum, insoluble polyvinylpyrrolidone, cross-linked PVP and (inadequate chemical term) polyvinylpolypyrrolidone (PVPP). Such products are items of commerce and are available from BASF SE under the product designations Kollidon®CL, KOLLIDON CL-F, -SF and -M or from ISP under the product designations Polyplasdone®XL and XL-10.

In contrast, soluble polyvinylpyrrolidone are widely used as auxiliary material (e.g. as binder, rheology modifier or complexing agent), for example in pharmaceutical industry and also in detergent additives. Such materials are commercially available in different average molecular weight and can be obtained as solutions in water or as free-flowing powders. For example, powders from BASF SE for the pharmaceutical industry are available under the product designations Kollidon® 12 PF, Kollidon® 25, Kollidon® 30 and Kollidon® 90 F. For detergent and cleaners, a selection of products from BASF SE are Sokalan® HP 165, Sokalan® HP 50, Sokalan® HP 53, Sokalan® HP 59, and from ISP under the product designation PVP K-15, PVP K-30, PVP K-60 and PVP K-90. Soluble polyvinylpyrrolidones are not preferred materials for component b) in the context of this invention.

One of the most prominent property of cross-linked polyvinylpyrrolidone is the build-up of swelling-pressure in water without forming a gel.

According to a preferred embodiment, the cross-linked polyvinylpyrrolidone component b) has a swelling pressure [kpa] from about 25.0 to 200.0 and a hydration capacity from 2.0 to 10.0 g water per g of the cross-linked polyvinylpyrrolidone. The methods for determination of these properties can be found in the literature (hydration capacity: S. Kornblum, S. Stoopak, *J. Pharm. Sci.* 62 (1973) 43-49; swelling pressure: a compilation of methods is given in: Bühler, V. Kollidon: *Polyvinylpyrrolidone Excipients for the Pharmaceutical Industry. 9th ed.* Ludwigshafen, Germany: BASF SE; 2008:152-153 ff).

Some specific insoluble grades of KOLLIDON have the following swelling pressure and time to reach 90% of the maximum swelling pressure [s]:

| | KOLLIDON CL | KOLLIDON CL-F | KOLLIDON CL-SF | KOLLIDON CL-M |
|---|---|---|---|---|
| Swelling pressure [kPa] | ca. 170 | ca. 30 | ca. 25 | Ca. 70 |
| Time to reach 90% of the maximum swelling pressure [s] | <10 | <15 | <35 | >100 |

Some specific insoluble grades of KOLLIDON have the following hydration capacity which is calculated as the quotient of the weight after hydration and the initial weight:

| | KOLLIDON CL | KOLLIDON CL-F | KOLLIDON CL-SF | KOLLIDON CL-M |
|---|---|---|---|---|
| g water/g polymer | 3.5-5.5 | 5.0-6.6 | 7.0-8.5 | 3.0-4.5 |

The insoluble grades of KOLLIDON have different specific surface areas from less than 1.0 $m^2/g$ to more than 6.0 $m^2/g$: Kollidon®CL: <1.0 $m^2/g$, KOLLIDON CL-F: ca. 1.5 $m^2/g$, KOLLIDON CL-SF: ca. 3.0 $m^2/g$ and KOLLIDON CL-M: >6.0 $m^2/g$.

The insoluble grades of KOLLIDON have different particle sizes in the range from <15 μm to <250 μm:

| | KOLLIDON CL | KOLLIDON CL-F | KOLLIDON CL-SF | KOLLIDON CL-M |
|---|---|---|---|---|
| <15 μm | | | ≥25% | ≥90% |
| <50 μm | ≤60% | >50% | | |
| <250 μm | ≥95% | ≥95% | ≥99% | |

The amount of cross-linked polyvinylpyrrolidone according to component b) may vary within wide limits, particularly from 0.5-40.0 wt.-%, based on the total weight of the composition.

According to a preferred embodiment, the amount of cross-linked polyvinylpyrrolidone is from about 0.5-30.0 wt.-%, based on the total weight of the composition.

The hydrophilic binding agent of component c) is a water-soluble or at least water-dispersible polymer or wax-type polymer selected from the group consisting of gelatines, polyacrylates, polymethacrylates, copolymers of ethyl acrylate, methyl methacrylate and methacrylic acid (ammonium salt), vinyl acetates, copolymers of styrene and acrylic acid, polycarboxylic acids, polyacrylamides, carboxymethyl cellulose, hydroxymethyl cellulose, polyvinyl alcohols, hydrolyzed and non-hydrolyzed polyvinyl acetate, copolymers of maleic acid with unsaturated hydrocarbons and also mixed polymerization products of the mentioned polymers. Further suitable substances are polyethylene glycol (MW: 2000-20 000), copolymers of ethylene oxide with propylene oxide (MW>3500), condensation products (block polymerization products) of alkylene oxide, especially propylene oxide, ethylene oxide-propylene oxide addition products with diamines, especially ethylenediamine, polystyrenesulphonic acid, polyethylenesulphonic acid, copolymers of acrylic acid with sulphonated styrenes, gum arabic, hydroxypropyl methylcellulose, sodium carboxymethyl cellulose, hydroxypropyl methylcellulose phthalate, maltodextrin, sucrose, lactose, enzymatically modified and subsequently hydrated sugars, as are obtainable under the name "Isomalt", cane sugar, polyaspartic acid and tragacanth.

Among those binding agents, special preference is given to sodium carboxymethyl cellulose, hydroxypropyl methylcellulose, polyacrylamides, polyvinyl alcohols, gelatins, hydrolyzed polyvinyl acetates, maltodextrins, polyaspartic acid and also polyacrylates and polymethacrylates.

The amount of binding agent according to component c) may vary within wide limits, particularly from 3.0-40.0 wt.-%, based on the total weight of the composition.

According to a preferred embodiment, the amount of binding agent is from about 3.0-20.0 wt.-%, based on the total weight of the composition.

The agglomerates, particularly the granules, according to the invention contain from 5.0-95.0 wt.-%, preferably from 20.0-90.0 wt.-%, of at least one further additive (component d)), based on the total weight of the granule.

Such further additives may be anionic dispersing agents; inorganic salts, aluminium silicates such as zeolites, and also compounds such as talc, kaolin; further disintegrants such as, for example, powdered or fibrous cellulose, microcrystalline cellulose; fillers such as, for example, dextrin, starch as for example corn starch or potato starch; water-insoluble or water-soluble dyes or pigments; and also optical brighteners. $TiO_2$, $SiO_2$ or magnesium trisilicate may also be used in small amounts, for example 0.0 to 10.0 wt.-%, based on the weight of the total composition.

The anionic dispersing agents used are, for example, the commercially available water-soluble anionic dispersing agents for dyes, pigments etc.

The following products are listed as examples: condensation products of aromatic sulphonic acids and formaldehyde, condensation products of aromatic sulphonic acids with unsubstituted or chlorinated biphenyls or biphenyl oxides and optionally formaldehyde, (mono-/di-)alkylnaphthalenesulphonates, sodium salts of polymerized organic sulphonic acids, sodium salts of polymerized alkylnaphthalenesulphonic acids, sodium salts of polymerized alkylbenzenesulphonic acids, alkylarylsulphonates, sodium salts of alkyl polyglycol ether sulphates, polyalkylated polynuclear arylsulphonates, methylene-linked condensation products of arylsulphonic acids and hydroxyarylsulphonic acids, sodium salts of dialkylsulphosuccinic acids, sodium salts of alkyl diglycol ether sulphates, sodium salts of polynaphthalenemethanesulphonates, ligno- or oxylignosulphonates or heterocyclic polysulphonic acids.

Especially suitable anionic dispersing agents are condensation products of naphthalenesulphonic acids with formaldehyde, sodium salts of polymerized organic sulphonic acids, (mono-/di-)alkylnaphthalenesulphonates, polyalkylated polynuclear arylsulphonates, sodium salts of polymerized alkylbenzenesulphonic acid, lignosulphonates, oxylignosulphonates and condensation products of naphthalenesulphonic acid with a polychloromethylbiphenyl.

The agglomerates, particularly the granules, according to the invention may contain residual moisture. This water level may range from 3.0 to 15.0 wt.-%, based on the total weight of the granule.

The invention also relates to a process for the preparation of the agglomerates, particularly the granules described above, which comprises mixing simultaneously or subsequently a) At least one water-soluble phthalocyanine compound;
b) At least one cross-linked polyvinylpyrrolidone component; and
c) At least one hydrophilic binding agent; and, optionally,
d) Further additives suitable for the preparation of agglomerates, converting the mixture into a workable mass, and drying.

The agglomerates, particularly the granules, are prepared according to known methods. Any known method is suitable to produce granules comprising the inventive mixture. Continuous or discontinuous methods are suitable. Continuous methods, such as spray drying or fluidised bed granulation processes are preferred. Such methods are for instance described in WO 2004/022693.

The invention also relates to solid agglomerates, particularly granules, which comprise a) At least one water-soluble phthalocyanine compound;
b) At least one cross-linked polyvinylpyrrolidone component;
c) At least one hydrophilic binding agent; and, optionally,
d) Further additives suitable for the preparation of solid agglomerates.

According to a preferred embodiment, the agglomerates, particularly the granules, have an average particle size of <500 μm.

According to a particularly preferred embodiment, the agglomerates, particularly the granules, have an average particle size of 50 to 200 μm.

The invention also relates to a washing agent composition, which comprises

A) Solid agglomerates, particularly granules, as defined above; and
B) Further additives suitable for the preparation of washing agents.

According to a preferred embodiment, the invention relates to a washing agent composition, which comprises A) 0.001 to 1.0 wt.-% solid agglomerates, particularly granules, as defined above; and
B) 99.0 to 99.999 wt.-% further additives suitable for the preparation of washing agents.

Such washing agent compositions comprise

I) 5.0 to 70.0 wt.-% A) of at least one surfactant selected from the group of anionic surfactants, based on the total weight of the washing agent formulation;
II) 0.0 to 60.0 wt.-% B) of at least one builder substance, based on the total weight of the washing agent formulation;
III) 0.0 to 30.0 wt.-% C) of at least one peroxide and, optionally, at least one activator and/or at least one catalyst, based on the total weight of the washing agent formulation;
IV) 0.001 to 5.0 wt.-% D) of agglomerates, particularly granules, as defined above, based on the total weight of the washing agent formulation;
V) 0.0 to 60.0 wt.-% E) of at least one further additive, based on the total weight of the washing agent formulation; and
VI) 0.0 to 5.0 wt.-% F) water, based on the total weight of the washing agent formulation;

Provided that the sum of the weight percentages of components I)-VI) in the formulation is 100%.

The anionic surfactant A) can be, for example, a sulphate, sulphonate or carboxylate surfactant or a mixture thereof. Preferred sulphates are those having from 12 to 22 C-atoms in the alkyl radical, optionally in combination with alkyl ethoxysulphates in which the alkyl radical has from 10 to 20 C-atoms.

Preferred sulphonates are e.g. alkylbenzene sulphonates having from 9 to 15 C-atoms in the alkyl radical. The cation in the case of anionic surfactants is preferably an alkali metal cation, especially sodium.

The anionic surfactant component may be, e.g., an alkylbenzene sulphonate, an alkylsulphate, an alkylether sulphate, an olefin sulphonate, an alkane sulphonate, a fatty acid salt, an alkyl or alkenyl ether carboxylate or an sulpho fatty acid salt or an ester thereof. Preferred are alkylbenzene sulphonates having 10 to 20 C-atoms in the alkyl group, alkyl sulphates having 8 to 18 C-atoms, alkylether sulphates having 8 to 22 C-atoms, and fatty acid salts being derived from palm oil or tallow and having 8 to 22 C-atoms. The average molar number of ethylene oxide added in the alkylether sulphate is preferably 1 to 22, preferably 1 to 10. The salts are preferably derived from an alkaline metal like sodium and potassium, especially sodium. Highly preferred carboxylates are alkali metal sarcosinates of the formula $$R_{109}—CO(R_{110})CH_2COOM_1,$$

in which $R_{109}$ is alkyl or alkenyl having 8-20 C-atoms in the alkyl or alkenyl radical, $R_{110}$ is $C_1$-$C_4$ alkyl and $M_1$ is an alkali metal, especially sodium.

The total amount of anionic surfactant is preferably 5-50 wt.-%, preferably 5-40 wt.-% and more preferably 5-30 wt.-%. As to these surfactants it is preferred that the lower limit is 10 wt.-%.

Suitable builder substances B) are, for example, alkali metal phosphates, especially tripolyphosphates, carbonates or hydrogen carbonates, especially their sodium salts, silicates, aluminosilicates, polycarboxylates, polycarboxylic acids, organic phosphonates, aminoalkylenepoly(alkylenephosphonates) or mixtures of those compounds.

Especially suitable silicates are sodium salts of crystalline layered silicates of the formula $Na—HSi_tO_{2t+1}.pH_2O$ or $Na_2Si_tO_{2t+1}.pH_2O$ wherein t is a number from 1.9 to 4 and p is a number from 0 to 20.

Among the aluminosilicates, preference is given to those commercially available under the names ZEOLITH A, B, X and HS, and also to mixtures comprising two or more of those components. ZEOLITH A is preferred.

Among the polycarboxylates, preference is given to polyhydroxycarboxylates, especially citrates, and acrylates and also copolymers thereof with maleic anhydride. Preferred polycarboxylic acids are nitrilotriacetic acid, ethylenediaminetetraacetic acid and ethylenediamine disuccinate either in racemic form or in the form of pure enantiomers (S,S).

Phosphonates or aminoalkylenepoly(alkylenephosphonates) that are especially suitable are alkali metal salts of 1-hydroxyethane-1,1-diphosphonic acid, nitrilotris(methylenephosphonic acid), ethylenediaminetetramethylenephosphonic acid, hexamethylenediamine-N,N,N',N'-tetrakis methanephosphonic acid and diethylenetriaminepentamethylenephosphonic acid, as well as the salts thereof. Also preferred polyphosphonates have the following formula

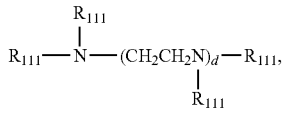

Wherein $R_{111}$ is $CH_2PO_3H_2$ or a water soluble salt thereof; and d is an integer of the value 0, 1, 2 or 3;

are preferred.

Especially preferred are the polyphosphonates wherein b is an integer of the value of 1.

Suitable peroxide components C) include, for example, the organic and inorganic peroxides (like sodium percarbonate or sodium perborate) known in the literature and available commercially that bleach textile materials at conventional washing temperatures, for example from 5 to 95° C.

The amount of the peroxide or the peroxide-forming substance is preferably 0.5-30.0 wt.-%, more preferably 1.0-20.0 wt.-% and especially preferably 1.0-15.0 wt.-%.

Suitable peroxides of component C) are compounds capable of yielding hydrogen peroxide in aqueous solutions, for example, the organic and inorganic peroxides known in the literature and available commercially that bleach textile materials at conventional washing temperatures, for example from 5 to 95° C.

The organic peroxides are, for example, mono- or polyperoxides, urea peroxides, a combination of a $C_1$-$C_4$alkanol oxidase and $C_1$-$C_4$alkanol, such as methanol oxidase and ethanol as described in WO 95/07972, alkylhydroxy peroxides, such as cumene hydroperoxide and t-butyl hydroperoxide, organic mono peracids of formula

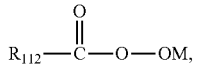

Wherein

M signifies hydrogen or a cation;

$R_{112}$ signifies unsubstituted $C_1$-$C_{18}$alkyl; substituted $C_1$-$C_{18}$alkyl; unsubstituted aryl; substituted aryl; —($C_1$-$C_6$alkylene)-aryl, wherein the alkylene and/or the alkyl group may be substituted; and phthalimido$C_1$-$C_8$alkylene, wherein the phthalimido and/or the alkylene group may be substituted.

Preferred mono organic peroxy acids and their salts are those of the formula;

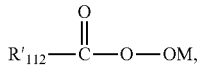

Wherein

M signifies hydrogen or an alkali metal, and $R'_{112}$ signifies unsubstituted $C_1$-$C_4$alkyl; phenyl; —$C_1$-$C_2$alkylene-phenyl or phthalimido$C_1$-$C_8$alkylene.

Especially preferred is $CH_3COOOH$ and its alkali salts.

Especially preferred is also epsilon-phthalimido peroxy hexanoic acid and its alkali salts.

Rather than using peroxy acid itself, one may is also use organic peroxy acid precursors and $H_2O_2$. Such precursors are the corresponding carboxy acid or the corresponding carboxy anhydride or the corresponding carbonyl chloride, or amides, or esters, which can form the peroxy acids on perhydrolysis. Such reactions are commonly known.

Peroxy acids may also be generated from precursors, such as bleach activators, that is to say compounds that, under perhydrolysis conditions, yield unsubstituted or substituted perbenzo- and/or peroxo-carboxylic acids having from 1 to 10 C-atoms, especially from 2 to 4 C-atoms. Tetraacetyl ethylenediamine (TAED) is used as the activator in laundry compositions commonly used in Europe. Laundry compositions commonly used in the U.S., on the other hand, are frequently based on sodium nonanoylbenzosulfonate (NaNOBS). Activator systems are effective in general, but the bleaching action of currently customary activators is inadequate under certain but desirable washing conditions (e.g. low temperature, short wash cycle). These and other activators not directly leading to peroxy acids are described in WO 0116273 and WO 03104199.

The composition may contain one or more optical brighteners, for example from the groups bis-triazinylamino-stilbenedisulphonic acid, bis-triazolyl-stilbenedisulphonic acid, bis-styrylbiphenyl or bis-benzofuranylbiphenyl, bis-benzoxalyl derivatives, bis-benzimidazolyl derivatives or coumarin derivatives or pyrazoline derivatives.

The optical brighteners may be selected from a wide range of groups, such as 4,4'-bis-(triazinylamino)-stilbene-2,2'-disulphonic acids, 4,4'-bis-(triazol-2-yl)stilbene-2,2'-disulphonic acids, 4,4'-(diphenyl)-stilbenes, 4,4'-distyryl-biphenyls, 4-phenyl-4'-benzoxazolyl-stilbenes, stilbenylnaphthotriazoles, 4-styryl-stilbenes, bis-(benzoxazol-2-yl) derivatives, bis-(benzimidazol-2-yl) derivatives, coumarines, pyrazolines, naphthalimides, triazinyl-pyrenes, 2-styryl-benzoxazole- or -naphthoxazole derivatives, benzimidazole-benzofuran derivatives or oxanilide derivatives. These optical brighteners are known and commercially available (for example Tinopal® CBS-X, Tinopal® DMA-X, Tinopal® 5BM-GX from BASF). They are described inter alia in WO 2006/024612.

The composition may contain one or more auxiliaries, such as soil suspending agents, for example sodium carboxymethylcellulose; salts for adjusting the pH, for example alkali or alkaline earth metal silicates; foam regulators, for example soap; salts for adjusting the spray drying and granulating properties, for example sodium sulphate; perfumes; and also, if appropriate, antistatic and softening agents; such as smectite clays; photo bleaching agents; pigments; and/or shading agents. These constituents preferably should, of course, be stable to any bleaching system employed. Such auxiliaries can be present in an amount of, for example, 0.1 to 20.0 wt.-%, preferably 0.5 to 10.0 wt.-%, especially 0.5 to 5.0 wt.-%, based on the total weight of the detergent.

Furthermore, the composition can optionally contain enzymes. Enzymes can be added to detergents for stain removal. The enzymes usually improve the performance on stains that are either protein- or starch-based, such as those caused by blood, milk, grease or fruit juices. Preferred enzymes are cellulases, proteases, amylases and lipases. Preferred enzymes are cellulases and proteases, especially proteases. Cellulases are enzymes which act on cellulose and its derivatives and hydrolyze them into glucose, cellobiose, cellooligosaccharide. Cellulases remove dirt and have the effect of mitigating the roughness to the touch. Examples of enzymes to be used include, but are by no means limited to, the following:

Commercially available detergent proteases, such as Alcalase®, Esperase®, Everlase®, Savinase®, Kannase® and Durazym®;

Commercially available detergent amylases, such as Termamyl®, Duramyl®, Stainzyme®, Natalase®, Ban® and Fungamyl®;

Commercially available detergent cellulases, such as Celluzyme®, Carezyme® and Endolase®;

Commercially available detergent lipases, such as Lipolase®, Lipolase Ultra® and Lipoprime®; Suitable mannanases, such as Mannanaway®;

These enzymes are commercially available from NOVOZYMES A/S.

The enzymes can optionally be present in the detergent. When used, the enzymes are usually present in an amount of 0.01-5.0 wt.-%, preferably 0.05-5.0 wt.-% and more preferably 0.1-4.0 wt.-%, based on the total weight of the detergent.

Further preferred additives to the agents according to the invention are dye fixing agents and/or polymers which, during the washing of textiles, prevent staining caused by dyes in the washing liquor that have been released from the textiles under the washing conditions. Such polymers are preferably polyvinylpyrrolidones, polyvinylimidazole or polyvinylpyridine-N-oxides which may have been modified by the incorporation of anionic or cationic substituents, especially those having a molecular weight in the range of from 5000 to 60 000, more especially from 5000 to 50 000. Such polymers are usually used in an amount of from 0.01 to 5.0 wt.-%, preferably 0.05 to 5.0 wt.-%, especially 0.1 to 2.0 wt.-%, based on the total weight of the detergent. Preferred polymers are those given in WO 02/02865, see especially page 1, last paragraph and page 2, first paragraph.

The washing agent composition according to the invention can be prepared in a generally known manner.

A composition in powder form can be prepared, for example, by first preparing an initial powder by spray-drying an aqueous slurry comprising all of the aforementioned components except for components C) and D) and then adding the dry components C) and D) and mixing all of them together. It is also possible to start from an aqueous slurry which, although comprising components A) and B), does not comprise all of component A). The slurry is spray-dried; component D) is then mixed with component B) and added; and then component C) is mixed in dry. The components are preferably mixed with one another in such amounts that a solid compact washing agent composition in granule form is obtained, having a specific weight of at least 500 g/l.

According to a specific embodiment of the process, the production of the washing agent composition is carried out in three steps. In the first step a mixture of anionic surfactant and builder substance is prepared. In the second step peroxide and, where appropriate, the agglomerates, particularly the granules according to the invention, are added. That method is usually carried out in a fluidised bed. In a further preferred embodiment, the individual steps are not carried out completely separately, so that there is a certain amount of overlap between them. Such a method is usually carried out in an extruder, in order to obtain granules in the form of "megapearls".

As an alternative thereto, the agglomerates according to the invention can, for the purpose of admixture with a washing agent in a post-dosing step, be mixed with other washing agent components such as phosphates, zeolites, brighteners or enzymes.

A mixture of that kind for post-dosing of the agglomerates is distinguished by a homogeneous distribution of the agglomerates according to the invention in the mixture and can consist of, for example, from 5 to 50% granules and from 95 to 50% sodium tripolyphosphate. Where the dark appearance of the granulate in the washing agent composition is to be suppressed, this can be achieved, for example, by embedding the agglomerates in droplets of a whitish meltable substance ("water-soluble wax") or, preferably, by encapsulating the agglomerates in a melt consisting of, for example, a water-soluble wax, as described in EP 0 323 407, a white solid (e.g. titanium dioxide) being added to the melt in order to reinforce the masking effect of the capsule.

A further aspect of the invention is a shading process for textile fibre materials characterized in that the textile fibre material is treated with a composition, which comprises a) At least one water-soluble phthalocyanine compound;
b) At least one cross-linked polyvinylpyrrolidone component;
c) At least one hydrophilic binding agent; and, optionally,
d) Further additives suitable for the preparation of solid agglomerates, particularly granules; and
e) Water In such a shading process the compositions of the invention are typically used in a detergent or washing agent composition. The amount of the compounds used is, for example, from 0.0001 to 1 wt.-%, preferably from 0.001 to 0.5 wt.-%, based on the weight of the textile material.

Examples of suitable textile fibre materials are materials made of silk, wool, polyamide, acrylics or polyurethanes, and, in particular, cellulosic fibre materials and blends of all types. Such fibre materials are, for example, natural cellulose fibres, such as cotton, linen, jute and hemp, and regenerated cellulose. Preference is given to textile fibre materials made of cotton. Also suitable are hydroxyl-containing fibres which are present in mixed fabrics, for example mixtures of cotton with polyester fibres or polyamide fibres.

The shading composition may be in any physical form, preferably in a solid form. Typical solid forms are powder, tablets or granules. Granules are preferred as solid formulation.

The inventive shading process is part of a laundry washing process. It can be part of any step of the laundry washing process (pre-soaking, main washing and after-treatment). The process can be carried out in a washing machine as well as by hand. The usual temperature is between 5° C. and 95° C.

The washing or cleaning agents are usually formulated that the washing liquor has a pH value of about 6.5-11, preferably 7.5-11, during the whole washing procedure.

The liquor ratio in the washing process is usually 1:4 to 1:40, preferably 1:4 to 1:30.

The following Examples illustrate the invention:

EXAMPLES

1 Test Materials and Compositions

1.1 Preparation of zinc phthalocyanine sulphonic acid conjugates with 4,4'-[[6-[(3-aminophenyl) amino]-1,3,5-triazine-2,4-diyl]diimino]bis[5-hydroxy-6-[2-(1-naphthalenyl)diazenyl]-2,7-naphthalenedisulphonic acid (CAS-No. 1159843-59-0)

1.1.1 Acetylation of H-acid 191.9 g (0.5 mol) 4-amino-5-hydroxy-naphthalene-2,7-disulphonic acid (83%, CAS-No. 90-20-0) are suspended in 500 ml water and dissolved at pH 7 by addition of 48.6 ml aqueous NaOH (30%). 92.1 g acetic acid anhydride are slowly added within 10 minutes. The reaction mixture is cooled to 10° C. by addition of 250.0 g ice. A pH-level of 7 is adjusted by addition of 118.3 ml aqueous NaOH (30%). 56.2 ml aqueous NaOH (30%) are added subsequently. A pH-level of 10.5 is maintained for 1 hour at a temperature of 30° C. by addition of 4.8 ml aqueous NaOH (30%). By addition of 32.9 ml aqueous HCl (32%) the solution is adjusted to a pH-level of 7.2. After cooling to 20° C. with 180 g ice, 1594 g solution of acetylated H-acid (ca. 0.5 mol) is obtained.

1.1.2 Diazotation and Coupling of 1-Naphthylamine 57.3 g (0.4 mol) 1-naphthylamine is added with stirring as a melt to a mixture of 800 ml water and 40.0 ml aqueous HCl (32%). Aqueous HCl (97.2 ml, 32%) is added, and the solution is cooled to 0° C. with 530 g ice. 90 ml of aqueous sodium nitrite (4N) is added within 15 minutes. During the addition, the temperature is maintained below 4° C. After further addition of 11 ml aqueous sodium nitrite, the reaction mixture is stirred for 30 minutes. 1 Mol of sulphamic acid is added subsequently to decompose any remaining nitrite.

To the suspension thus obtained, 1275.0 g (0.4 mol) of the acetylated H-acid (pH 4.8) described above (1.1.1) is poured within a minute. A pH-level of 7.5 is adjusted with 327 ml of aqueous sodium carbonate solution (20% w/v). The solution is stirred at room temperature for 12 hours. The total volume of reaction solution is about 3.4 l. For hydrolysis, 340 ml aqueous NaOH (30%) are added to the reaction mixture, followed by heating to 90° C. for 3 hours. A pH-level of 7.5 is adjusted by the addition of 292.5 ml of aqueous HCl (32%). The violet suspension is stirred at room temperature for 12 hours. The volume of the reaction solution is about 4 l. The formed precipitate is filtered off to yield 518.7 g (84.4%) 5-amino-4-hydroxy-3-[2-(1-naphthalenyl)diazenyl]-2,7-naphthalenedisulphonic acid (CAS-No. 103787-67-3) as a paste.

1.1.3 Preparation of 4,4'-[[6-[(3-aminophenyl) amino]-1,3,5-triazine-2,4-diyl]diimino]bis[5-hydroxy-6-[2-(1-naphthalenyl)diazenyl]-2,7-naphthalenedisulphonic acid ("Dye", CAS-No. 1159843-59-0)

An aqueous solution of 0.060 mol 5-amino-4-hydroxy-3 (naphthalene-1-ylazo)-naphthalene-2,7-disulphonic acid is stirred at room temperature. A suspension consisting of 100 ml of ice water, 0.1 g disodium hydrogen tetraoxophosphate and 5.53 g (0.03 mol) cyanuric chloride is added. The reaction mixture is adjusted with aqueous NaOH (30%) and maintained at pH 7. After 30 minutes, the reaction mixture is heated to 70° C. and maintained at a pH-level of 7 for several hours until the coupling reaction with cyanuric chloride is complete as indicated by LC.

To this solution (ca. 0.030 mol intermediate), a solution of 5.59 g (0.0031 mol) m-phenylenediamine dihydrochloride in 50 ml water is added. The reaction mixture is heated to 95° C. A pH value of 8.5 is maintained by addition of aqueous NaOH (30%). The reaction is monitored by LC. After 3 hours, the reaction mixture is cooled to room temperature and a volume of 950 ml solution is obtained. For isolation of the product, 237.5 g sodium chloride is added. The reaction mixture is stirred for another 12 hours. The formed precipitate is filtered off and dried to give 42.2 g dye ($UV_{vis}$ $\lambda_{max}$: 536 nm).

1.1.4 Sulphonation and Sulphonyl Chloride Formation of Zinc(II) Phthalocyanine (Bis- and Tris-Sulphonated Zinc Phthalocyanines)

A mixture of 16.55 ml (31.4 g) fuming sulphuric acid (nominally 20% free $SO_3$) and 12.8 ml (24.8 g) fuming sulphuric acid (65% free $SO_3$) is stirred at 20° C. 12.5 g (0.0195 mol) zinc phthalocyanine (90% active) is added to this solution within 5-10 minutes. The reaction mixture is heated to 75° C. and maintained for 30 minutes at that temperature. The reaction mixture is poured within 10 minutes into 330.0 g of a mixture of ice and water. A pH-level of 7 is adjusted, and the temperature of the solution is maintained below 25° C. The crude zinc phthalocyanine sulphonic acid mixture is desalted by dialysis and freeze-dried to give 13 g of a dark blue solid to give a mixture of bis- and tris-sulphonated zinc phthalocyanine isomers.

1.5 g of this dry mixture is suspended in 14.94 g (0.128 mol) chlorosulphuric acid. The reaction mixture is heated to 87° C. and maintained at this temperature for 30 minutes. 1.05 ml (1.72 g, 0.014 mol) thionyl chloride is added dropwise within 45 minutes. The reaction mixture is maintained at 87° C. for two more hours. The solution is allowed to cool to 30° C. and poured within 10 minutes into 25.0 g of an ice/water mixture. The temperature of the solution is maintained at 0-5° C. by further addition of ice. The formed precipitate is filtered off and washed with aqueous sodium chloride solution (3%) to give a crude mixture of sulphonyl chlorides.

1.1.5 Sulphonation and Sulphonyl Chloride Formation of Zinc(II) Phthalocyanine (Mono- and Bis-Sulphonated Zinc Phthalocyanines)

A solution of 30 ml (56.9 g) fuming sulphuric acid (nominally 20% free $SO_3$) is warmed up and stirred at 40° C. 12.5 g (21.6 mmol) zinc phthalocyanine is added in portions within 5-10 minutes. The reaction mixture is heated to 60-65° C. and stirred for 90 minutes at that temperature. The dark reaction suspension is slowly poured into 330 g of an ice/water mixture. By the addition of sodium hydroxide solution (50%), the suspension is adjusted to pH 7, and the mixture is stirred for another two hours. The crude product is desalted by dialysis and freeze-dried to give 13 g dark blue powder to give a mixture of essentially mono- and bis-sulphonated zinc phthalocyanines.

1.35 g of this dry mixture is slowly added to 8.8 ml (14.94 g, 0.128 mmol) chlorosulphuric acid. The reaction mixture is heated to 87° C. and maintained at this temperature for 30 minutes. 1.05 ml (1.72 g, 0.014 mol) thionyl chloride is added drop wise within 30-45 minutes and stirring is continued for two hours. Within 45 minutes, the reaction solution is cooled to 25° C. and poured into 140 g of a water/ice mixture. The formed precipitate is filtered off and washed with sodium chloride solution (3%) to give a crude mixture of sulphonyl chlorides.

1.1.6 Preparation of Zinc(II) Phthalocyanine Dye Conjugate I

Freshly prepared (1.1.4) moist zinc phthalocyanine sulphonyl chloride (about 0.0195 mol) is dissolved in ice-cold water. An aqueous solution (ca. 0.0195 mol) of the dye (1.1.3) is added within 5 minutes. The reaction mixture is adjusted with aqueous NaOH (32%) to a pH-level of 7. The reaction mixture is heated to 50° C. and stirred for 2 hours, cooled to 25° C. and stirred for another eight hours. The reaction mixture is maintained at a pH-level of 7 with aqueous NaOH (32%). The completion of the reaction is monitored by TLC. The crude reaction mixture is desalted by nanofiltration to give a product containing about 10% active zinc(II) phthalocyanine dye conjugate (main conjugate signal in ESI-MS [M+]: 1927), which is used for further formulation processing.

1.1.7 Preparation of Zinc(II) Phthalocyanine Dye Conjugate II

The crude filter cake (1.1.5; approx. 1.95 mmol) is suspended in a freshly prepared ice-cold water/dimethoxyethane 1:1 (v/v) mixture. The reaction solution is immediately adjusted to pH 4-5 with sodium hydroxide solution (50%). The dye (1.1.3, approx. 1.95 mmol) is dissolved in 20 ml water and added drop wise within 5-10 minutes. The reaction mixture is stirred for 25° C. for 12 hours. The reaction mixture is maintained at a pH-level of 7 with aqueous NaOH (32%). The reaction mixture is monitored by TLC. Optionally, the reaction mixture is heated to 50° C. to ensure complete conversion.

The mixture is evaporated under vacuum at 60-70° C. to remove organic volatiles to the desired spectroscopic strength (main conjugate signals in ESI-MS [$M^+$]: 1767 and 1847 along with minor amounts of 1927).

The aqueous zinc phthalocyanine dye conjugate solution can be used directly for granule formation or it can be desalted by dialysis and lyophilized. Alternative cosolvents to dimethoxyethane (e.g. alcoholic) solvents are also suitable.

1.2 Preparation of Agglomerates

The following compositions are prepared as indicated in Table 1. Solid content of the materials is measured by IR balance operated at 140° C.

TABLE 1

| | No. of Composition Components [wt.-%] | | | | | |
|---|---|---|---|---|---|---|
| | 1.2.1 | 1.2.2[1)] | 1.2.3 | 1.2.4 | 1.2.5[1)] | 1.2.6 |
| ZnPcDC[2)] | 6.7 | 6.8 | 6.8 | 4.2 | 4.2 | 7.1 |
| Cross-linked PVP | 10.8 | — | 11.0 | 11.3 | — | 8.5 |
| Corn Starch | 37.8 | 49.2 | 29.8 | 38.4 | 51.2 | 30.6 |
| Zeolite 4A | 32.2 | 32.4 | 32.7 | 33.8 | 33.8 | 27.7 |
| Gelatin | 5.5 | 5.6 | 5.6 | 5.8 | 5.8 | 8.2 |

TABLE 1-continued

| | No. of Composition Components [wt.-%] | | | | | |
|---|---|---|---|---|---|---|
| | 1.2.1 | 1.2.2[1)] | 1.2.3 | 1.2.4 | 1.2.5[1)] | 1.2.6 |
| Anionic Dispersant | — | — | 6.9 | — | — | 7.0 |
| Hydrophobic Silica | — | — | 0.7 | 0.4 | — | 0.8 |
| Water | 7.0 | 6.0 | 6.5 | 6.1 | 5.0 | 10.1 |

[1)]Referential Composition

[2)]Zinc-Phthalocyanine Dye Conjugate I: 1.2.1, 1.2.2, 1.2.3, 1.2.4; 1.2.5
Zinc-Phthalocyanine Dye Conjugate II: 1.2.6

1.2.1 Composition with Cross-Linked PVP

The solution of zinc(II) phthalocyanine dye conjugate I obtained from (1.1.6) is dried into a powder with a solid content of 97 wt.-%. 5.0 g of this powder is dry-blended in a mixer with 27.0 g of corn starch (Cargill, solid content 88 wt.-%) and 25.0 g of Zeolite 4A (Silkem, solid content 93 wt.-%). 20.0 g of a 20 wt.-% solution of gelatine (Gelita, type A) in water is prepared as binder solution, and a blend of 4.0 g of corn starch and 8.0 g of cross-linked PVP powder (KOLLIDON CL-F, BASF, solid content of 98 wt.-%) as powdering agent. 4.0 g of the binder solution are blended with the solids in the mixer, and then 3.0 g of the powdering agent is added and thoroughly mixed. This procedure is repeated for three times. Then the final portion of the binder solution is added and the wet powder is further blended in the mixer for homogenization and agglomeration. The material obtained is dried at 80° C. and sieved to 100-160 μm particle size. The resulting agglomerates contain 7.2% of the ZnPcDC photo catalyst with respect to dry matter of the material.

1.2.2 Referential Example, Control

Analogous to Example 1.2.1. 28.0 g of corn starch, 25.0 g of Zeolite 4A and 5.0 g of dried ZnPcDC photo catalyst powder obtained from the solution of zinc(II) phthalocyanine dye conjugate I (1.1.6) are blended with 20.0 g of the binder solution. The powdering agent consists of 12.0 g of corn starch only. No cross-linked PVP is present in the composition. Processing of the agglomerates analogous to 1.2.1.

1.2.3 Composition with Cross-Linked PVP

Analogous to 1.2.1. The ZnPcDC solution (1.1.6) is blended in water with the sodium salt of a condensate of naphthalene¬ sulphonic acid with formaldehyde as the anionic dispersant, and dried into a powder that contains equal amounts of ZnPcDC and dispersant at 93 wt.-% solid content. 10.5 g of the formulated ZnPcDC powder, 20.0 g of corn starch and 25.0 g of Zeolite 4A are blended with 20.0 g of the binder solution. A mixture of 4.0 g of corn starch and 8.0 g of cross-linked PVP powder (KOLLIDON CL-F, BASF) is used as powdering agent. Starting with the binder solution, portions of binder and powdering agent are subsequently blended with the dry powder mix analogous to Example 1.2.1. After adding half of the powdering agent, 0.5 g of fine hydrophobic silica (Sipernat® D17, EVONIK) is blended with the remaining powdering agent. Further processing of the agglomerates is analogous to 1.2.1.

1.2.4 Composition with Cross-Linked PVP 26.0 g of corn starch (Cargill) is dry-blended with 25.0 g of Zeolite 4A and 3.0 g of dried ZnPcDC photo catalyst powder obtained from the solution of zinc (II) phthalocyanine dye conjugate I (1.1.6). 20.0 g of a 20 wt.-% aqueous gelatine solution (Gelita, type A) is prepared as binder solution, and a blend of 4.0 g of corn starch and 8.0 g of cross-linked PVP powder (KOLLIDON CL-F, BASF) as powdering agent. Starting with the binder solution, portions of binder and powdering agent are subsequently blended with the dry powder mix analogous to 1.2.1. After adding half of the powdering agent, 0.3 g of fine hydrophobic silica (Sipernat® D17, EVONIK) is blended with the remaining powdering agent. Further processing is analogous to 1.2.1.

1.2.5 Referential Composition, Control

Analogous to Example 1.2.4. 28.0 g of corn starch, 25.0 g of Zeolite 4A and 3.0 g of dried ZnPcDC photo catalyst powder obtained from the solution of zinc(II) phthalocyanine dye conjugate I (1.1.6) are blended with 20.0 g of the binder solution. The powdering agent consists of 12.0 g of corn starch only. No cross-linked PVP is present in the composition. Processing of the agglomerates analogous to 1.2.1.

1.2.6 Composition with cross-linked PVP

The zinc(II) phthalocyanine dye conjugate II solution obtained from (1.1.7) is blended with the sodium salt of a condensate of naphthalene-sulphonic acid with formaldehyde as the anionic dispersant, and dried into a powder that contains equal amounts of zinc(II) phthalocyanine dye conjugate II and the dispersant at 95 wt.-% solid content. 12.0 g of this powder, 20.0 g of corn starch and 24.0 g of Zeolite 4A are dry-blended in a mixer. 33.0 g of a 20 wt.-% aqueous gelatine solution (Gelita, type A) is prepared as binder solution, and a blend of 8.0 g of corn starch and 7.0 g of cross-linked PVP powder (KOLLIDON CL-F, BASF) is used as powdering agent. Starting with the binder solution, portions of binder and powdering agent are subsequently blended with the dry powder mix analogous to Example 1.2.1. After adding half of the powdering agent, 0.7 g of fine hydrophobic silica (Sipernat® D17, EVONIK) is blended with the remaining powdering agent. Further processing of the agglomerates is analogous to 1.2.1.

2 Application Tests 2.1 Spotting Tests

The compositions 1.2.1-1.2.5 are weighted into a detergent powder containing no photo catalyst active and are then thoroughly mixed using a turbula laboratory mixer until a homogenous distribution in the detergent is achieved. ECE 77 detergent (ECE reference detergent 77, from EMPA Test Materials) is used, and a level of 0.3 wt.-% of the granule is chosen for all tests.

The spotting test used for evaluation of the agglomerates is outlined in WO 2003/018740. Six 15×15 cm pieces of white bleached woven non-mercerised cotton are placed flat on the bottom of a bowl containing 1 l of tap water. 10 g of ECE 77 detergent containing the particle compositions are spread on the cloth and then left for 10 minutes. Then the cloth is thoroughly rinsed, dried and then evaluated on a scale ranging from 0 (no discoloration of the fabric, no spots) to 4 (full spotting). The results of the spotting evaluations are reported in Table 2.

2.2 Exhaustion and Spotting-in-Use

Bleached cotton is washed for 15 minutes at 30° C. with ECE 77 detergent at a 20 g/kg fabric and a liquor ratio of 1:20, in the presence of composition 1.2.1, 1.2.2 and 1.2.3 (concentration of 20 mg/1) in LINITEST equipment (Atlas). Before the addition of cotton, the composition is allowed to stand for 1 minute at ambient temperature. After rinsing with tap water, spin-drying and ironing, the exhaustion of the active dye on the fabric is measured by reflectance spectroscopy by using the Kubelka/Munk formula K/S. The higher the K/S-value, the higher the exhaustion of the active dye on the cotton fabric. The results are reported in Table 3.

2.3 Release in the Wash

Analogous to the procedure in 2.2, the washing experiments are performed with 6.9 mg/l (average of 7 independent washing runs) of composition 1.2.6. The CIELAB D65/10b* value of the cotton fabric is measured in order to determine the hueing ability (blue shift) of the composition. For comparative purposes, the experiment is modified in such a way that the composition is gently swirled for 20 minutes at ambient temperature. This ensures complete dissolution of the solid composition before starting the washing. The results are reported in Table 4.

3 Results

TABLE 2

Spotting tests (2.1)

| | No. of Composition | | | | |
|---|---|---|---|---|---|
| Components [wt.-%] | 1.2.1 | 1.2.2[1)] | 1.2.3 | 1.2.4 | 1.2.5[1)] |
| ZnPcDC | 7.2 | 7.2 | 7.3 | 4.5 | 4.5 |
| Cross-linked PVP | 11.6 | — | 11.8 | 12.1 | — |
| Spotting Result on Fabric | 1-2 | 2-3 | 2 | 1 | 2 |

[1)]Referential Composition

TABLE 3

Exhaustion and spotting in use (2.2)

| Composition | K/S (680 nm) vs. zero amount of composition | Relative K/S (680 nm) |
|---|---|---|
| 1.2.1 | 0.202 | 123% |
| 1.2.2 | 0.0164 | 100% |
| 1.2.3 | 0.0200 | 122% |

The results reported in Table 3 show that the two compositions that contain cross-linked PVP give rise to a higher exhaustion of active dye on the fabric as compared with agglomerates that contain no disintegrant PVP (composition 1.2.2). This indicates an excellent release of the dye, and no exhaustion inhibiting interaction of disintegrant and dye in the wash liquor is found. Two thirds of the fabric washed in the presence of composition 1.2.2 show blueish-violet stains caused by incomplete disintegration, whereas no stains are visible when inventive compositions 1.2.1 and 1.2.3 are tested.

TABLE 4

| Release in the wash | | |
|---|---|---|
| Composition | b * average | Standard deviation |
| 1.2.6 | −1.8 | 0.23 |
| 1.2.6 dissolved in wash liquor prior to wash | −1.9 | 0.22 |

The addition of compositions in the form of particles has no negative effect on the hueing performance as compared with agglomerates completely dissolved when beginning with the wash. The spotting performance remains within the expected acceptable range for use in consumer detergents.

The invention claimed is:

1. A washing agent composition comprising

I) 5.0 to 70.0 wt.-% A) of at least one surfactant selected from the group of anionic surfactants, based on the total weight of the washing agent formulation;

II) 0.0 to 60.0 wt.-% B) of at least one builder substance, based on the total weight of the washing agent formulation;

III) 0.0 to 30.0 wt.-% C) of at least one peroxide and, optionally, at least one activator and/or at least one catalyst, based on the total weight of the washing agent formulation;

IV) 0.001 to 5.0 wt.-% D) of granules, based on the total weight of the washing agent formulation, which granules comprise a) at least one water-soluble phthalocyanine compound;

b) at least one cross-linked polyvinylpyrrolidone component;

c) at least one hydrophilic binding agent selected from the group consisting of sodium carboxymethyl cellulose, hydroxypropyl methylcellulose, polyacrylamides, polyvinyl alcohols, gelatines, hydrolyzed polyvinyl acetates, maltodextrin, polyaspartic acid, polyacrylates and polymethacrylates, and, optionally, d) further additives suitable for the preparation of granules, V) 0.0 to 60.0 wt.-% E) of at least one further additive, based on the total weight of the washing agent formulation; and VI) 0.0 to 5.0 wt.-% F) water, based on the total weight of the washing agent formulation;

provided that the sum of the weight percentages of components I)-VI) in the composition is 100%.

2. A composition according to claim 1, wherein the granules D) comprise a) 0.1-20.0 wt.-% of the water-soluble phthalocyanine compound;

b) 0.5-40.0 wt.-% of the cross-linked polyvinylpyrrolidone component;

c) 3.0-40.0 wt.-% of the hydrophilic binding agent; and, optionally, d) 5.0-95.0 wt.-% of further additives suitable for the preparation of granules; and e) 3.0-15.0 wt.-% of water;

provided that the sum of components a), b), c), d) and e) amounts up to 100 wt.-%.

3. The composition according to claim 1, wherein the granules D) comprise a) 0.1-10.0 wt.-% of the water-soluble phthalocyanine compound;

b) 0.5-30.0 wt.-% of the cross-linked polyvinylpyrrolidone component;

c) 3.0-20.0 wt.-% of the hydrophilic binding agent; and, optionally, d) 20.0-90.0 wt.-% of further additives suitable for the preparation of granules; and e) 3.0-15.0 wt.-% of water;

provided that the sum of components a), b), c), d) and e) amounts up to 100 wt.-%.

4. The composition according to claim 1, which comprises, as water-soluble phthalocyanine component a), at least one phthalocyanine complex compound of the formula (PC)-L-(D) (1), to which the substituent of at least one mono-azo dye is attached by the linking group L, Wherein PC represents the Zn(II), Fe(II), Ca(II), Mg(II), Na(I), K(I), Al, Si(IV), P(V), Ti(IV) or Cr(VI) metal-containing phthalocyanine structure;

D represents the substituent of a mono-azo dye; and

L represents a group

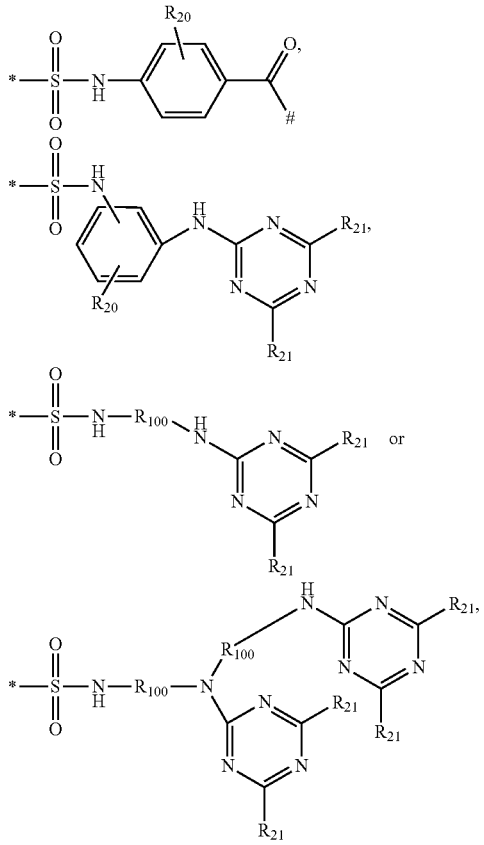

Wherein $R_{20}$ represents hydrogen, $C_1$-$C_8$alkyl, $C_1$-$C_8$alkoxy or halogen;

$R_{21}$ represents D, hydrogen, OH, Cl or F, provided that at least one is D;

$R_{100}$ represents $C_1$-$C_8$alkylene;

* marks the point of attachment of PC; and # marks the point of attachment of the substituent D of the mono-azo dye.

5. The composition according to claim 4, wherein the water-soluble phthalocyanine complex compound (1) corresponds to the formula (1a)

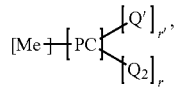

Wherein

PC represents the porphyrine structure,

Me represents the central metal atom or central metal group coordinated to PC, which is selected from the group consisting of Zn, Fe, Ca, Mg, Na, K, Al—$Z_1$, Si(IV)-$(Z_1)_2$, Ti(IV)-$(Z_1)_2$ and Sn(IV)-$(Z_1)_2$;

$Z_1$ represents $C_1$-$C_8$alkanolate, $OH^-$, $R_0COO^-$, $ClO_4^-$, $BF_4^-$, $PF_6^-$, $R_0SO_3^-$, $SO_4^{2-}$, $NO_3^-$, $F^-$, $Cl^-$, $Br^-$, $I^-$, citrate, tartrate or oxalate, wherein $R_0$ is hydrogen or $C_1$-$C_{18}$alkyl;

r represents 0 or a numeral from 1 to 3;

r' represents a numeral from 1 to 4;

each $Q_2$ independently of one another represents —$SO_3^-$ $M^+$ or the group —$(CH_2)_m$—COO $M^+$; wherein $M^+$ is $H^+$ an alkali metal ion or the ammonium ion and m is 0 or a numeral from 1 to 12;

each Q' independently of one another represents the segment of the partial formula -L-D, Wherein D represents the substituent of a mono-azo dye; and L represents a group

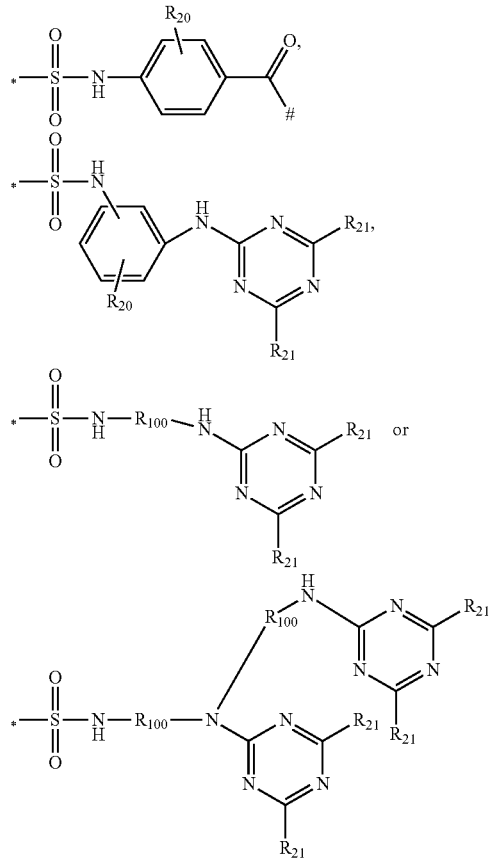

Wherein $R_{20}$ represents hydrogen, $C_1$-$C_8$alkyl, $C_1$-$C_8$alkoxy or halogen;

$R_{21}$ represents D, hydrogen, OH, Cl or F, provided that at least one of $R_{21}$ is D;

$R_{100}$ represents $C_1$-$C_8$alkylene;

* marks the point of attachment of Me-PC; and # marks the point of attachment of the substituent D of the mono-azo dye.

6. The composition according to claim 4, wherein the water-soluble phthalocyanine complex compound (1) corresponds to the formula (2a)

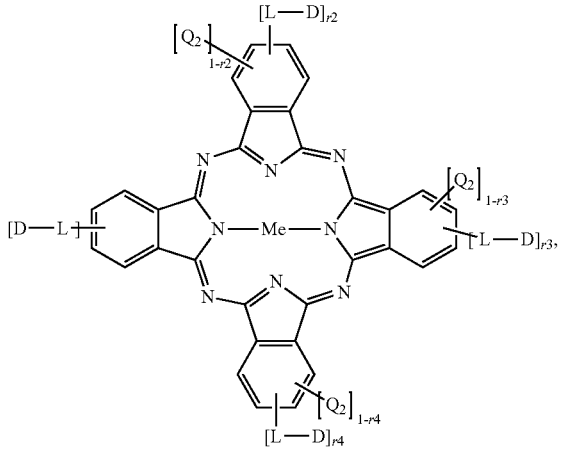

Wherein

Me represents Zn, Al—$Z_1$, Si(IV)-$(Z_1)_2$ or Ti(IV)-$(Z_1)_2$, wherein $Z_1$ is chloride, fluoride, bromide or hydroxide;

each $Q_2$ independently of one another represents —$SO_3^-$ $M^+$ or the group —$(CH_2)_m$—COO $M^+$, wherein $M^+$ is $H^+$, an alkali metal ion or the ammonium ion and m is 0 or a numeral from 1 to 12;

D represents the substituent of a mono-azo dye; and

L represents a group

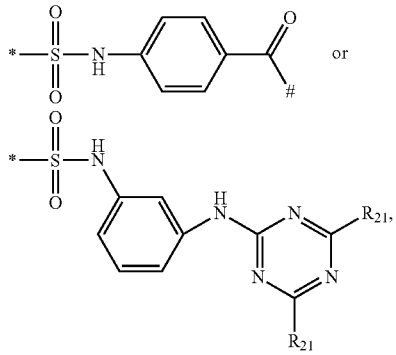

Wherein $R_{21}$ represents D, hydrogen, OH, Cl or F, provided that at least one is D;

* marks the point of attachment of PC;

# marks the point of attachment to D;

$r_2$ represents 0 or 1;

$r_3$ represents 0 or 1; and $r_4$ represents 0 or 1.

7. The composition according to claim 6, wherein Me represents Zn.

8. The composition according to claim 4, wherein D represents the substituent of a mono-azo dye of the partial formulae Xa, Xb, Xc or Xd:

(Xa)

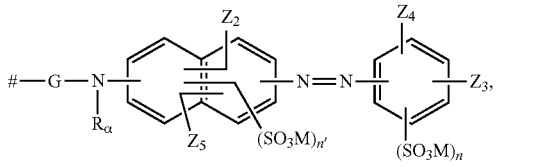

(Xb)

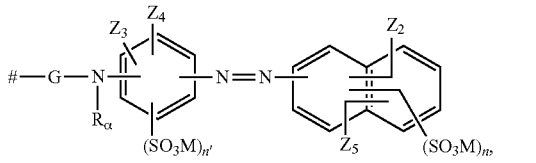

(Xc)

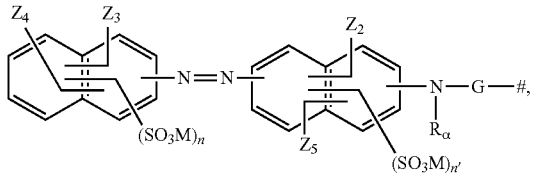

(Xd)

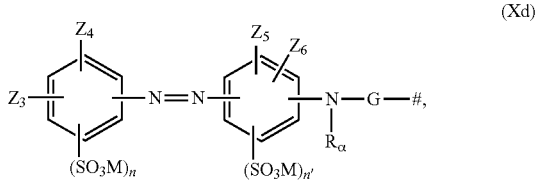

Wherein # marks the point of attachment of the bridging group L;

$R_\alpha$ represents hydrogen, $C_1$-$C_4$alkyl, $C_1$-$C_2$alkyl which is substituted by at least one substituent selected from the group consisting of hydroxy, cyano, $SO_3H$, $NH_2$, carboxy, $C_1$-$C_4$alkoxycarbonyl, $C_1$-$C_4$alkoxy, phenyl, naphthyl and pyridyl, straight chain or branched $C_3$-$C_4$-alkyl which is substituted by at least one substituent selected from the group consisting of hydroxy, cyano, $SO_3H$, $NH_2$, carboxy, $C_1$-$C_4$alkoxycarbonyl, $C_1$-$C_4$alkoxy, phenyl, naphthyl and pyridyl, aryl, aryl which is substituted by at least one substituent selected from the group consisting of hydroxy, cyano, $SO_3H$, $NH_2$, carboxy, $C_1$-$C_4$alkoxycarbonyl, $C_1$-$C_4$alkoxy and $C_1$-$C_4$alkyl;

$Z_2$, $Z_3$, $Z_4$, $Z_5$ and $Z_6$ independently of one another represent hydrogen, hydroxy, $C_1$-$C_4$alkyl, $C_1$-$C_2$alkyl which is substituted by at least one substituent selected from the group consisting of hydroxy, cyano, $SO_3H$, $NH_2$, carboxy, $C_1$-$C_4$alkoxycarbonyl, $C_1$-$C_4$alkoxy, phenyl, naphthyl and pyridyl, straight chain or branched $C_3$-$C_4$-alkyl which is substituted by at least one substituent selected from the group consisting of hydroxy, cyano, $SO_3H$, $NH_2$, carboxy, $C_1$-$C_4$alkoxycarbonyl, $C_1$-$C_4$alkoxy, phenyl, naphthyl and pyridyl, $C_1$-$C_4$alkoxy, $C_1$-$C_2$alkoxy which is substituted by at least one substituent selected from the group consisting of hydroxy, cyano, $SO_3H$, $NH_2$, carboxy, $C_1$-$C_4$alkoxycarbonyl, $C_1$-$C_4$alkoxy, phenyl, naphthyl and pyridyl, straight chain or branched $C_3$-$C_4$-alkoxy which is substituted by at least one substituent selected from the group consisting of hydroxy, cyano, $SO_3H$, $NH_2$, carboxy, $C_1$-$C_4$alkoxycarbonyl, $C_1$-$C_4$alkoxy, phenyl, naphthyl and pyridyl, halogen, —$SO_2CH_2CH_2SO_3H$, $NO_2$, COOH, —$COOC_1$-$C_4$alkyl, $NH_2$, $NHC_1$-$C_4$alkyl, wherein the alkyl group may be substituted by at least one substituent selected from the group consisting of OH, $NH_2$, $C_1$-$C_4$alkyl, CN and COOH, N($C_1$-$C_4$alkyl) $C_1$-$C_4$alkyl, wherein the alkyl groups may independently of one another be substituted by at least one substituent selected from the group consisting of OH, $NH_2$, $C_1$-$C_4$alkyl, CN and COOH, NH-aryl, NH-aryl, wherein aryl is substituted by at least one substituent selected from the group consisting of hydroxy, cyano, $SO_3H$, $NH_2$, carboxy, $C_1$-$C_4$alkoxycarbonyl, $C_1$-$C_4$alkyl and $C_1$-$C_4$alkoxy, or represents $NHCOC_1$-$C_4$alkyl or $NHCOOC_1$-$C_4$alkyl;

G represents the direct bond, —$COOC_1$-$C_4$alkylene, arylene; arylene which is substituted by at least one substituent selected from the group consisting of hydroxy, cyano, $NO_2$, $SO_3H$, $NH_2$, carboxy, $C_1$-$C_4$alkoxycarbonyl, $C_1$-$C_4$alkoxy and $C_1$-$C_4$alkyl, $C_1$-$C_4$alkylene, $C_1$-$C_4$-alkylene substituted by at least one substituent selected from the group consisting of hydroxy, cyano, $NO_2$, $SO_3H$, $NH_2$, carboxy, $C_1$-$C_4$alkoxycarbonyl, $C_1$-$C_4$alkoxy and $C_1$-$C_4$alkyl, or represents —CO-arylene;

n represents 0; 1; 2 or 3;

n' represents 0; 1 or 2; and each M independently of one another represents hydrogen; an alkali metal ion or an ammonium ion.

9. The composition according to claim 4, wherein D represents the substituent of a mono-azo dye of the partial formulae XIa, XIb, XIc or XId:

(XIa)

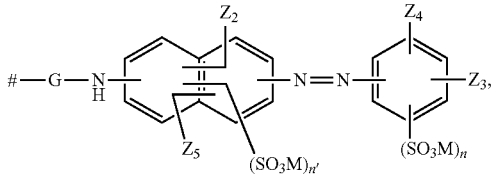

Wherein # marks the point of attachment of the bridging group L;

$Z_2$ represents $C_1$-$C_2$-alkyl, $C_1$-$C_2$-alkyl which is substituted by at least one substituent selected from the group consisting of hydroxy, cyano, $SO_3H$, $NH_2$, carboxy, $C_1$-$C_2$alkoxycarbonyl, $C_1$-$C_2$alkoxy, phenyl, naphthyl and pyridyl, $C_1$-$C_2$-alkoxy, $C_1$-$C_2$-alkoxy which is substituted by at least one substituent selected from the group consisting of hydroxy, cyano, $SO_3H$, $NH_2$, carboxy, $C_1$-$C_2$alkoxycarbonyl, $C_1$-$C_2$alkyl, phenyl, naphthyl and pyridyl, or represents OH;

$Z_3$ represents hydrogen, $C_1$-$C_2$-alkyl, $C_1$-$C_2$-alkyl which is substituted by at least one substituent selected from the group consisting of hydroxy, cyano, $SO_3H$, $NH_2$, carboxy, $C_1$-$C_2$alkoxycarbonyl, $C_1$-$C_2$alkoxy, phenyl, naphthyl and pyridyl, $C_1$-$C_2$-alkoxy, $C_1$-$C_2$-alkoxy which is substituted by at least one substituent selected from the group consisting of hydroxy, cyano, $SO_3H$, $NH_2$, carboxy, $C_1$-$C_2$alkoxycarbonyl, $C_1$-$C_2$alkyl, phenyl, naphthyl and pyridyl, OH, $NO_2$, $NH_2$, $NHC_1$-

$C_2$alkyl, wherein the alkyl group may be substituted by at least one substituent selected from the group consisting of OH, $NH_2$, $C_1$-$C_2$alkyl, CN and COOH, or represents $NHCOC_1$-$C_2$alkyl or $NHCOOC_1$-$C_2$alkyl;

$Z_4$ represents hydrogen, $C_1$-$C_2$-alkyl, $C_1$-$C_2$-alkyl which is substituted by at least one substituent selected from the group consisting of hydroxy, cyano, $SO_3H$, $NH_2$, carboxy, $C_1$-$C_2$alkoxycarbonyl, $C_1$-$C_2$alkoxy, phenyl, naphthyl and pyridyl, $C_1$-$C_2$-alkoxy, $C_1$-$C_2$-alkoxy which is substituted by at least one substituent selected from the group consisting of hydroxy, cyano, $SO_3H$, $NH_2$, carboxy, $C_1$-$C_4$alkoxycarbonyl, $C_1$-$C_4$alkyl, phenyl, naphthyl and pyridyl, OH, $NO_2$, $NH_2$, $NHC_1$-$C_2$alkyl, wherein the alkyl group may be substituted by at least one substituent selected from the group consisting of OH, $NH_2$, $C_1$-$C_2$alkyl, CN and COOH, or represents $NHCOC_1$-$C_2$alkyl or $NHCOOC_1$-$C_2$alkyl;

$Z_5$ represents hydrogen, $C_1$-$C_2$-alkyl, $C_1$-$C_2$-alkyl which is substituted by at least one substituent selected from the group consisting of hydroxy, cyano, $SO_3H$, $NH_2$, carboxy, $C_1$-$C_2$alkoxycarbonyl, $C_1$-$C_2$alkoxy, phenyl, naphthyl and pyridyl;

G represents the direct bond, $COOC_1$-$C_2$alkylene, arylene, arylene which is substituted by at least one substituent selected from the group consisting of hydroxy, cyano, $NO_2$, $SO_3H$, $NH_2$, carboxy, $C_1$-$C_2$alkoxycarbonyl, $C_1$-$C_2$alkoxy and $C_1$-$C_2$alkyl, $C_1$-$C_2$alkylene or $C_1$-$C_2$-alkylene which is substituted by at least one substituent selected from the group consisting of hydroxy, cyano, $NO_2$, $SO_3H$, $NH_2$, carboxy, $C_1$-$C_2$alkoxycarbonyl, $C_1$-$C_2$alkoxy and $C_1$-$C_2$alkyl;

n represents 0, 1, 2 or 3;

n' represents 0, 1 or 2; and each M independently of one another represents hydrogen, $Na^+$ or $K^+$;

(XIb)

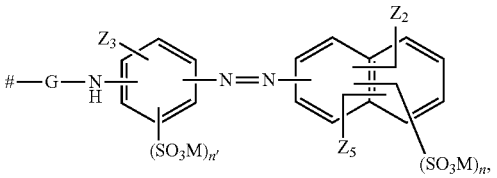

Wherein # marks the point of attachment of the bridging group L;

$Z_2$ represents $C_1$-$C_2$-alkyl, $C_1$-$C_2$-alkyl which is substituted by at least one substituent selected from the group consisting of hydroxy, cyano, $SO_3H$, $NH_2$, carboxy, $C_1$-$C_2$alkoxycarbonyl, $C_1$-$C_2$alkoxy, phenyl, naphthyl and pyridyl, $C_1$-$C_2$-alkoxy, $C_1$-$C_2$-alkoxy which is substituted by at least one substituent selected from the group consisting of hydroxy, cyano, $SO_3H$, $NH_2$, carboxy, $C_1$-$C_2$alkoxycarbonyl, $C_1$-$C_2$alkyl, phenyl, naphthyl and pyridyl or represents OH;

$Z_3$ is hydrogen, $C_1$-$C_2$-alkyl, $C_1$-$C_2$-alkyl which is substituted by at least one substituent selected from the group consisting of hydroxy, cyano, $SO_3H$, $NH_2$, carboxy, $C_1$-$C_2$alkoxycarbonyl, $C_1$-$C_2$alkoxy, phenyl, naphthyl and pyridyl, $C_1$-$C_2$-alkoxy, $C_1$-$C_2$-alkoxy which is substituted by at least one substituent selected from the group consisting of hydroxy, cyano, $SO_3H$, $NH_2$, carboxy, $C_1$-$C_2$alkoxycarbonyl, $C_1$-$C_2$alkyl, phenyl, naphthyl and pyridyl, OH, $NO_2$, $NH_2$, $NHC_1$-$C_2$alkyl, wherein the alkyl group may be substituted by at least one substituent selected from the group consisting of OH, $NH_2$, $C_1$-$C_2$alkyl, CN or COOH or represents $NHCOC_1$-$C_2$alkyl or $NHCOOC_1$-$C_2$alkyl;

$Z_5$ represents hydrogen, $C_1$-$C_2$-alkyl or $C_1$-$C_2$-alkyl which is substituted by at least one substituent selected from the group consisting of hydroxy, cyano, $SO_3H$, $NH_2$, carboxy, $C_1$-$C_2$alkoxycarbonyl, $C_1$-$C_2$alkoxy, phenyl, naphthyl and pyridyl;

G represents the direct bond, $COOC_1$-$C_2$alkylene, arylene, arylene which is substituted by at least one substituent selected from the group consisting of hydroxy, cyano, $NO_2$, $SO_3H$, $NH_2$, carboxy, $C_1$-$C_2$alkoxycarbonyl, $C_1$-$C_2$alkoxy and $C_1$-$C_2$alkyl, $C_1$-$C_2$alkylene or $C_1$-$C_2$-alkylene which is substituted by at least one substituent selected from the group consisting of hydroxy, cyano, $NO_2$, $SO_3H$, $NH_2$, carboxy, $C_1$-$C_2$alkoxycarbonyl, $C_1$-$C_2$alkoxy and $C_1$-$C_2$alkyl;

n represents 0, 1, 2 or 3;

N' is 0, 1 or 2; and each M independently of one another represents hydrogen, $Na^+$ or $K^+$;

(XIc)

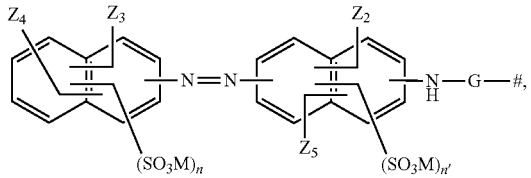

Wherein # marks the point of attachment of the bridging group L;

$Z_2$ represents hydrogen, hydroxy, $C_1$-$C_2$-alkyl, $C_1$-$C_2$-alkyl which is substituted by at least one substituent selected from the group consisting of hydroxy, cyano, $SO_3H$, $NH_2$, carboxy, $C_1$-$C_2$alkoxycarbonyl, $C_1$-$C_2$alkoxy, phenyl, naphthyl and pyridyl, $C_1$-$C_2$-alkoxy or $C_1$-$C_2$-alkoxy which is substituted by at least one substituent selected from the group consisting of hydroxy, cyano, $SO_3H$, $NH_2$, carboxy, $C_1$-$C_4$alkoxycarbonyl, $C_1$-$C_4$alkyl, phenyl, naphthyl and pyridyl, or represents OH or $NO_2$;

$Z_3$ represents hydrogen, $C_1$-$C_2$-alkyl, $C_1$-$C_2$-alkyl which is substituted by at least one substituent selected from the group consisting of hydroxy, cyano, $SO_3H$, $NH_2$, carboxy, $C_1$-$C_2$alkoxycarbonyl, $C_1$-$C_2$alkoxy, phenyl, naphthyl and pyridyl, $C_1$-$C_2$-alkoxy, $C_1$-$C_2$-alkoxy which is substituted by at least one substituent selected from the group consisting of hydroxy, cyano, $SO_3H$, $NH_2$, carboxy, $C_1$-$C_2$alkoxycarbonyl, $C_1$-$C_2$alkyl, phenyl, naphthyl and pyridyl, OH, $NO_2$, $NH_2$, $NHC_1$-$C_2$alkyl, wherein the alkyl group may be substituted by at least one substituent selected from the group consisting of OH, $NH_2$, $C_1$-$C_2$alkyl, CN and COOH, or represents $NHCOC_1$-$C_2$alkyl or $NHCOOC_1$-$C_2$alkyl;

$Z_4$ represents hydrogen, $C_1$-$C_2$-alkyl, $C_1$-$C_2$-alkyl which is substituted by at least one substituent selected from the group consisting of hydroxy, cyano, $SO_3H$, $NH_2$, carboxy, $C_1$-$C_2$alkoxycarbonyl, $C_1$-$C_2$alkoxy, phenyl, naphthyl and pyridyl, $C_1$-$C_2$-alkoxy or $C_1$-$C_2$-alkoxy which is substituted by at least one substituent selected from the group consisting of hydroxy, cyano, $SO_3H$, $NH_2$, carboxy, $C_1$-$C_4$alkoxycarbonyl, $C_1$-$C_4$alkyl, phenyl, naphthyl and pyridyl, OH, $NO_2$, $NH_2$, $NHC_1$-$C_2$alkyl, wherein the alkyl group may be substituted by at least one substituent selected from the group consisting of OH, $NH_2$, $C_1$-$C_2$alkyl, CN and COOH, or represents $NHCOC_1$-$C_2$alkyl or $NHCOOC_1$-$C_2$alkyl;

$Z_5$ represents hydrogen, $C_1$-$C_2$-alkyl, $C_1$-$C_2$-alkyl which is substituted by at least one substituent selected from the group consisting of hydroxy, cyano, $SO_3H$, $NH_2$, carboxy, $C_1$-$C_2$alkoxycarbonyl, $C_1$-$C_2$alkoxy, phenyl, naphthyl and pyridyl, $C_1$-$C_2$-alkoxy, $C_1$-$C_2$-alkoxy which is substituted by at least one substituent selected from the group consisting of hydroxy, cyano, $SO_3H$, $NH_2$, carboxy, $C_1$-$C_4$alkoxycarbonyl, $C_1$-$C_4$alkyl, phenyl, naphthyl and pyridyl, or represents $NO_2$;

G represents the direct bond, $COOC_1$-$C_2$alkylene, arylene, arylene which is substituted by at least one substituent selected from the group consisting of hydroxy, cyano, $NO_2$, $SO_3H$, $NH_2$, carboxy, $C_1$-$C_2$alkoxycarbonyl, $C_1$-$C_2$alkoxy and $C_1$-$C_2$alkyl, $C_1$-$C_2$alkylene or $C_1$-$C_2$-alkylene which is substituted by at least one substituent selected from the group consisting of hydroxy, cyano, $NO_2$, $SO_3H$, $NH_2$, carboxy, $C_1$-$C_2$alkoxycarbonyl, $C_1$-$C_2$alkoxy and $C_1$-$C_2$alkyl, n represents 0, 1, 2 or 3;

n' represents 0, 1 or 2; and each M independently of one another represents $Na^+$ or $K^+$;

(XId)

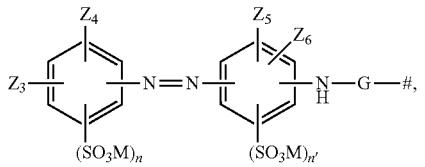

Wherein # marks the point of attachment of the bridging group L;

$Z_3$ represents hydrogen, $C_1$-$C_2$-alkyl, $C_1$-$C_2$-alkyl which is substituted by at least one substituent selected from the group consisting of hydroxy, cyano, $SO_3H$, $NH_2$, carboxy, $C_1$-$C_2$alkoxycarbonyl, $C_1$-$C_2$alkoxy, phenyl, naphthyl and pyridyl, $C_1$-$C_2$-alkoxy, $C_1$-$C_2$-alkoxy which is substituted by at least one substituent selected from the group consisting of hydroxy, cyano, $SO_3H$, $NH_2$, carboxy, $C_1$-$C_4$alkoxycarbonyl, $C_1$-$C_4$alkyl, phenyl, naphthyl and pyridyl, or represents $SO_2CH_2CH_2SO_3H$ or $NO_2$;

$Z_4$ represents $C_1$-$C_2$-alkyl, $C_1$-$C_2$-alkyl which is substituted by at least one substituent selected from the group consisting of hydroxy, cyano, $SO_3H$, $NH_2$, carboxy, $C_1$-$C_2$alkoxycarbonyl, $C_1$-$C_2$alkoxy, phenyl, naphthyl and pyridyl, $C_1$-$C_2$-alkoxy, $C_1$-$C_2$-alkoxy which is substituted by at least one substituent selected from the group consisting of hydroxy, cyano, $SO_3H$, $NH_2$, carboxy, $C_1$-$C_4$alkoxycarbonyl, $C_1$-$C_4$alkyl, phenyl, naphthyl and pyridyl, OH, or represents $SO_2CH_2CH_2SO_3H$, or $NO_2$;

$Z_5$ represents hydrogen, $C_1$-$C_2$-alkyl, $C_1$-$C_2$-alkyl which is substituted by at least one substituent selected from the group consisting of hydroxy, cyano, $SO_3H$, $NH_2$, carboxy, $C_1$-$C_2$alkoxycarbonyl, $C_1$-$C_2$alkoxy, phenyl, naphthyl and pyridyl, $C_1$-$C_2$-alkoxy, $C_1$-$C_2$-alkoxy which is substituted by at least one substituent selected from the group consisting of hydroxy, cyano, $SO_3H$, $NH_2$, carboxy, $C_1$-$C_4$alkoxycarbonyl, $C_1$-$C_4$alkyl, phenyl, naphthyl and pyridyl, OH, $NO_2$, $NH_2$, $NHC_1$-$C_2$alkyl, wherein the alkyl group may be substituted by at least one substituent selected from the group consisting of OH, $NH_2$, $C_1$-$C_2$alkyl, CN and COOH, or represents $NHCOC_1$-$C_2$alkyl or $NHCOOC_1$-$C_2$alkyl;

$Z_6$ represents $C_1$-$C_2$-alkyl, $C_1$-$C_2$-alkyl which is substituted by at least one substituent selected from the group consisting of hydroxy, cyano, $SO_3H$, $NH_2$, carboxy, $C_1$-$C_2$alkoxycarbonyl, $C_1$-$C_2$alkoxy, phenyl, naphthyl and pyridyl, $C_1$-$C_2$-alkoxy, $C_1$-$C_2$-alkoxy which is substituted by at least one substituent selected from the group consisting of hydroxy, cyano, $SO_3H$, $NH_2$, carboxy, $C_1$-$C_4$alkoxycarbonyl, $C_1$-$C_4$alkyl, phenyl, naphthyl and pyridyl, or represents $NO_2$;

G represents the direct bond, $COOC_1$-$C_2$alkylene, arylene, arylene which is substituted by at least one substituent selected from the group consisting of hydroxy, cyano, $NO_2$, $SO_3H$, $NH_2$, carboxy, $C_1$-$C_2$alkoxycarbonyl, $C_1$-$C_2$alkoxy and $C_1$-$C_2$alkyl, $C_1$-$C_2$alkylene or $C_1$-$C_2$-alkylene which is substituted by at least one substituent selected from the group consisting of hydroxy, cyano, $NO_2$, $SO_3H$, $NH_2$, carboxy, $C_1$-$C_2$alkoxycarbonyl, $C_1$-$C_2$alkoxy and $C_1$-$C_2$alkyl;

n represents 0, 1, 2 or 3;

n' represents 0, 1 or 2; and each M independently of one another represents hydrogen, $Na^+$ or $K^+$.

10. The composition according to claim 4, wherein D is selected from the group consisting of compounds, wherein the partial formulae 10, 11, 12, 13 and 14:

(10)

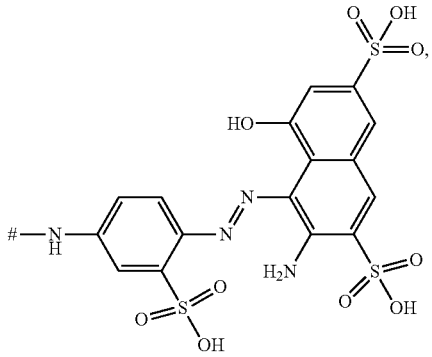

(11)

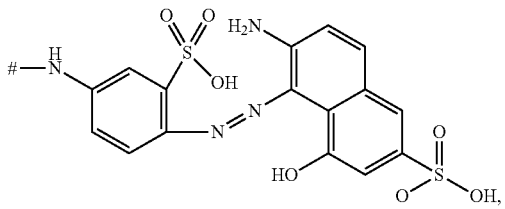

(12)

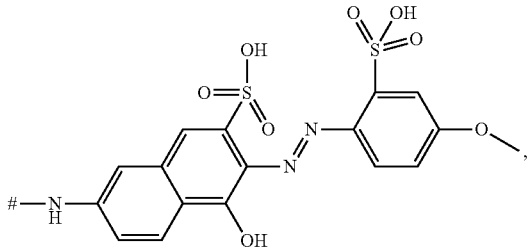

-continued (13)

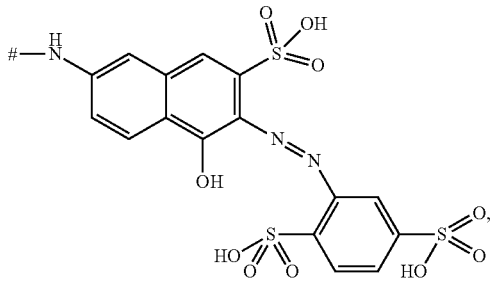

(14)

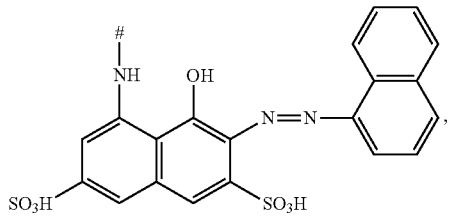

are present and wherein # marks the point of attachment of the bridging group L.

11. The composition according to claim 1, wherein the cross-linked polyvinylpyrrolidone component b) is insoluble in water.

12. The composition according to claim 1, wherein the cross-linked polyvinylpyrrolidone component b) has a swelling pressure [kpa] from 25.0 to 200.0 and a hydration capacity from 2.0 to 10.0 g water per g of the cross-linked polyvinylpyrrolidone.

13. The composition according to claim 1, wherein the further additives of Component d) are selected from the group consisting of anionic dispersants, disintegrants, fillers, water-insoluble or water-soluble dyes or pigments; optical brighteners, zeolites, talcum, powdered cellulose, fibrous cellulose, microcrystalline cellulose, starch, dextrin, kaolin, $TiO_2$ $SiO_2$ and magnesium trisilicate.

14. The composition according to claim 1, wherein the granules have an average particle size of <500 μm.

15. The composition according to claim 1, wherein the granules have an average particle size of 50 to 200 μm.

16. The composition according to claim 1, which comprises

A) 0.001 to 1.0 wt.-% granules D.

* * * * *